US010950251B2

(12) United States Patent
Nemer et al.

(10) Patent No.: US 10,950,251 B2
(45) Date of Patent: Mar. 16, 2021

(54) CODING OF HARMONIC SIGNALS IN TRANSFORM-BASED AUDIO CODECS

(71) Applicant: DTS, Inc., Calabasas, CA (US)

(72) Inventors: Elias Nemer, Irvine, CA (US); Zoran Fejzo, Los Angeles, CA (US)

(73) Assignee: DTS, Inc., Calabasas, CA (US)

( * ) Notice: Subject to any disclaimer, the term of this patent is extended or adjusted under 35 U.S.C. 154(b) by 92 days.

(21) Appl. No.: 16/183,189

(22) Filed: Nov. 7, 2018

(65) Prior Publication Data

US 2019/0272837 A1 Sep. 5, 2019

Related U.S. Application Data

(60) Provisional application No. 62/638,655, filed on Mar. 5, 2018.

(51) Int. Cl.

| | |
|---|---|
| ***G10L 19/038*** | (2013.01) |
| ***G10L 19/02*** | (2013.01) |
| ***G10L 19/005*** | (2013.01) |

(52) U.S. Cl.

CPC ..... *G10L 19/038* (2013.01); *G10L 19/005* (2013.01); *G10L 19/0204* (2013.01)

(58) Field of Classification Search

None

See application file for complete search history.

(56) References Cited

U.S. PATENT DOCUMENTS

| | | | | |
|---|---|---|---|---|
| 5,852,805 | A * | 12/1998 | Hiratsuka | G10L 19/005 704/500 |
| 5,870,703 | A | 2/1999 | Oikawa et al. | |
| 6,253,185 | B1 * | 6/2001 | Arean | H04S 1/00 704/201 |
| 6,295,009 | B1 * | 9/2001 | Goto | G10L 19/035 341/50 |
| 6,370,499 | B1 * | 4/2002 | Fujii | G10L 19/02 704/200.1 |
| 6,526,383 | B1 * | 2/2003 | Kurtz | H04B 14/046 704/500 |
| 7,181,079 | B2 * | 2/2007 | Herre | H04N 19/00 375/240.1 |
| 7,318,027 | B2 * | 1/2008 | Lennon | G10L 19/173 704/229 |

(Continued)

OTHER PUBLICATIONS

"International Application Serial No. PCT/US2019/020514, International Search Report dated May 16, 2019", 2 pgs.

(Continued)

*Primary Examiner* — Thuykhanh Le

(74) *Attorney, Agent, or Firm* — Schwegman Lundberg & Woessner, P.A.

(57) ABSTRACT

Systems and methods include audio encoders having improved coding of harmonic signals. The audio encoders can be implemented as transform-based codecs with frequency coefficients quantized using spectral weights. The frequency coefficients can be quantized by use of the generated spectral weights applied to the frequency coefficients prior to the quantization or by use of the generated spectral weights in computation of error within a vector quantization that performs the quantization. Additional apparatus, systems, and methods are disclosed.

20 Claims, 9 Drawing Sheets

(56) References Cited

U.S. PATENT DOCUMENTS 7,447,631 B2 * 11/2008 Truman ..... G10L 19/035 704/230
7,801,733 B2 * 9/2010 Lee ..... G10L 19/0204 704/500
8,224,658 B2 * 7/2012 Lei ..... G10L 19/24 704/500
8,645,127 B2 2/2014 Mehrotra et al.
2003/0026335 A1 * 2/2003 Thyagarajan ..... H04N 19/176 375/240.2
2003/0088423 A1 * 5/2003 Nishio ..... G10L 19/0208 704/500
2007/0172071 A1 * 7/2007 Mehrotra ..... H04S 3/008 381/23
2009/0006103 A1 * 1/2009 Koishida ..... G10L 19/167 704/500
2009/0040997 A1 * 2/2009 Oh ..... H04N 21/4347 370/345
2009/0228285 A1 * 9/2009 Schnell ..... G10L 21/038 704/500
2009/0240509 A1 * 9/2009 Song ..... G10L 21/038 704/500
2010/0023325 A1 * 1/2010 Bessette ..... H03M 7/3082 704/219
2010/0023336 A1 * 1/2010 Shmunk ..... G10L 19/0204 704/503
2010/0169081 A1 * 7/2010 Yamanashi ..... G10L 19/038 704/203
2010/0174532 A1 * 7/2010 Vos ..... G10L 19/07 704/205
2010/0228551 A1 * 9/2010 Ragot ..... H03M 7/00 704/500
2011/0173009 A1 * 7/2011 Fuchs ..... G10L 19/20 704/500
2011/0173012 A1 * 7/2011 Rettelbach ..... G10L 19/0204 704/500
2011/0238425 A1 * 9/2011 Neuendorf ..... G10L 19/18 704/500
2012/0263312 A1 * 10/2012 Takada ..... G10L 19/0204 381/73.1
2012/0288117 A1 * 11/2012 Kim ..... G10L 19/0204 381/94.2
2013/0259113 A1 * 10/2013 Kumar ..... H04L 25/03292 375/233
2013/0275140 A1 * 10/2013 Kim ..... G10L 19/032 704/500
2013/0339038 A1 * 12/2013 Norvell ..... G10L 19/083 704/500
2014/0074488 A1 * 3/2014 Vilermo ..... G10L 19/008 704/500
2014/0142958 A1 5/2014 Sharma et al.
2014/0156287 A1 6/2014 Koishida et al.
2015/0088529 A1 * 3/2015 Moriya ..... G10L 19/032 704/500
2015/0188556 A1 * 7/2015 Chen ..... H03M 1/0854 341/153
2015/0255078 A1 * 9/2015 Beack ..... G10L 19/0017 704/500
2015/0287417 A1 * 10/2015 Disch ..... G10L 19/025 704/500
2015/0332689 A1 * 11/2015 Disch ..... G10L 19/012 704/500
2016/0022164 A1 * 1/2016 Brockway ..... A61B 5/725 600/509
2016/0055855 A1 * 2/2016 Kjoerling ..... G10L 19/008 704/500
2016/0133265 A1 5/2016 Disch et al.
2016/0140973 A1 5/2016 Neukam et al.
2016/0140981 A1 5/2016 Niedermeier et al.
2016/0196826 A1 * 7/2016 Stone ..... G10L 19/035 704/200.1
2016/0210974 A1 7/2016 Disch et al.
2016/0217800 A1 * 7/2016 Purnhagen ..... H04S 1/007
2017/0154631 A1 6/2017 Disch et al.
2018/0102134 A1 4/2018 Disch
2018/0144760 A1 5/2018 Niedermeier et al.
2018/0278962 A1 * 9/2018 Johnston ..... G10L 19/008
2019/0362730 A1 * 11/2019 Svedberg ..... G10L 19/038

OTHER PUBLICATIONS

"International Application Serial No. PCT/US2019/020514, Written Opinion dated May 16, 2019"; 6 pgs.
Zernicki, Tomasz, et al., "Improved Coding of Tonal Components in MPEG-4AAC with SBR", 16th European Signal Processing Conference, (2008), 5 pgs.

* cited by examiner

CODING OF HARMONIC SIGNALS IN TRANSFORM-BASED AUDIO CODECS

RELATED APPLICATION

This application claims priority under 35 U.S.C. 119(e) from U.S. Provisional Application Ser. No. 62/638,655, filed 5 Mar. 2018, which application is incorporated herein by reference in its entirety.

FIELD OF THE INVENTION

The present invention relates generally to apparatus and methods of processing of audio signals.

BACKGROUND

In transform-based audio codecs employing vector quantizers, artifacts are commonly introduced when coding strongly harmonic signals. Strongly harmonic signals include such signals as recording of music notes played on instruments such as harmonica, violin, trumpets, etc., or a sustained vowel sound in a speech utterance or singing segment. The spectrum of these signals can include several harmonics, often related to each other or being multiples of a fundamental frequency. Because of the nature of the instrument, some of these harmonics are stronger in amplitude than others. In addition, there is natural amplitude fluctuation in time. The artifacts can be in the form of missing or broken harmonics. This results in audible distortion as weak harmonics are poorly quantized and reproduced. In typical transform-based audio codecs, an input audio signal is windowed and transformed into frames of frequency coefficients prior to quantization and encoding. The phrase "audio signal" is a signal that is representative of a physical sound. Typically, a modified discrete cosine transform (MDCT) is used with a changing time-frequency resolution, depending on whether frames are stationary or transient.

The MDCT spectrum is commonly divided into subbands, according to a perceptual scale and the coefficients of each band are normalized according to an energy or a scale factor-based scheme. The normalized coefficients are quantized using a scalar or vector quantization (VQ) scheme. An example of a vector quantizer is a Pyramid Vector Quantizer (PVQ). The PVQ uses a minimum-mean-square error (MSE) approach to code as many coefficients as possible, given the number of available bits. Bits allocated to various bands are converted into a number of pulses, which are then assigned to selected MDCT coefficients.

There are several techniques used to mitigate this problem of properly coding harmonic signals. One technique includes extracting a few main harmonies or tonal components and coding them separately. Another technique uses side information to transmit the temporal and spectral properties of these components to allow the decoder to recreate them. While in general these techniques are good they are not always efficient. For example, when there are multiple harmonics and the side information technique is used, a large number of bits are required to send the side information.

FIG. 1 is a representation of typical processing using transform-based audio codecs. Input audio samples are provided to an audio encoder 104 for time domain processing 105, which provides an input for a frequency transform 110. Results of frequency transform 110 are provided to a vector quantizer 115 to generate quantized coefficients.

Pulses assigned to these quantized coefficients are packed into a bitstream 125 for transport to an audio decoder 131. The transport can be conducted over a communication network. Audio decoder 131 receives input from bitstream 125 and provides the input to a vector de-quantizer 133 that provides an input to an inverse frequency processing 137. Inverse frequency processing 137 provides a time domain signal for time domain processing 139. For MDCT coefficients used for vector quantizer 115, the inverse frequency processing can be an inverse modified discrete cosine transform (IMCDT). Time domain processing 139 outputs audio samples representing the audio samples input to encoder 104 that are output from decoder 131 for use by audio devices.

FIG. 2 is a simplified block diagram of a typical transform-based encoder 204. Encoder 204 includes a number of operational units that can be realized as a combination of communication hardware and processing hardware to encode audio signals into a bitstream for transmission to a device having a decoder to decode the encoded audio signals to generate a signal representing the original audio signal received by encoder 204. An audio signal can be received as input audio samples by encoder 204, and an operational unit can perform time domain processing 205 and another operational unit can provide a window 207 to a frame of time samples of the input audio samples. Time samples from the window 207 can be provided for an operational unit to apply MDCT 210 to provide frequency samples. A band energy unit 211 can be used to provide band boundaries to divide the MDCT spectrum into bands and/or subbands. An operational unit to generate normalized MDCT coefficients 212 from the frequency samples provides input to a vector quantizer 215 that can assign pulses to selected MDCT coefficients. Vector quantizer 215 uses input from an operation unit for band bit allocation 214 that allocates bits to various bands using input from band energy unit 211. Vector quantizer outputs pulses for representing the input audio samples received by encoder 204 to an operational unit for parameter encoding and packing 218. Parameters from operation associated with each of time domain processing 205, band energy unit 211, and band bit allocated 214 are provided to the operational unit for parameter encoding and packing 218. These parameters can be encoded and packed with the output of vector quantizer 215 into a bitstream for transmission from encoder 204.

DETAILED DESCRIPTION

In the following description of embodiments of harmonic signal coding systems and methods, reference is made to the accompanying drawings. These drawings show, by way of illustration and not limitation, specific examples of how various embodiments may be practiced. These embodiments are described in sufficient detail to enable those skilled in the art to practice these and other embodiments. Other embodiments may be utilized, and structural, logical, electrical, and mechanical changes may be made to these embodiments. The various embodiments are not necessarily mutually exclusive, as some embodiments can be combined with one or more other embodiments to form new embodiments. Alternative embodiments are possible, and steps and elements discussed herein may be changed, added, or eliminated, depending on the particular embodiment. These alternative embodiments include alternative steps and alternative elements that may be used, and structural changes that may he made, without departing from the scope of the invention. The following detailed description is, therefore, not to be taken in a limiting sense.

Transform-based audio coding includes a process that transforms a time signal into a frequency-domain vector of coefficients prior to quantization and encoding. In a transform-based codec employing vector quantization, the signal spectrum can be divided into a number of frequency bands. For each band, a number of bits are assigned for quantization of transform coefficients. For a strongly harmonic signal, a given band can have several harmonics with some being strong and other weak. Depending of the fundamental frequency, for example a function of a note being played, as well as the size of the band, two or more harmonics may fall into a given band. The harmonics that fall in the same band may differ in amplitude, for instance there may be a strong harmonic with two other weak ones in the same band.

Frequency coefficients in a given band can be quantized as a single vector, after normalization. The VQ assigns pulses to the various coefficients according to a criteria of maximizing the signal-to-noise ratio (SNR) of the resulting quantized vector, where the signal is the original coefficient value, and the noise is the difference between the quantized coefficient and the original coefficient.

Figure 1:
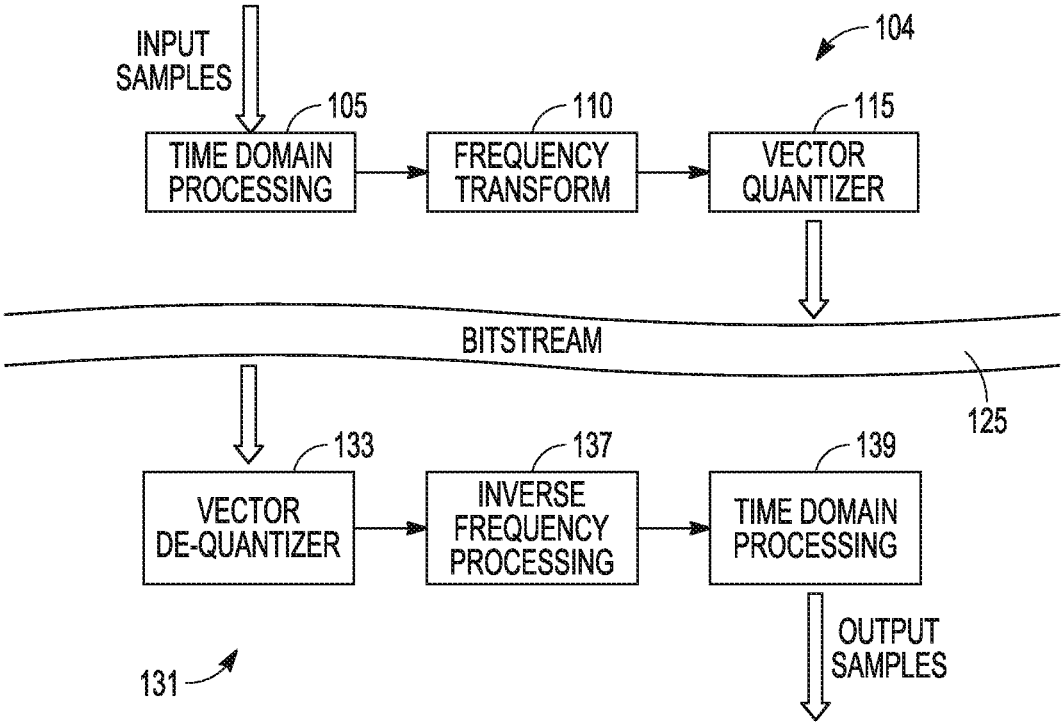
FIG. 1 (PRIOR ART)
FIG. 1 is a representation of typical processing using transform-based audio codecs.
Figure 2:
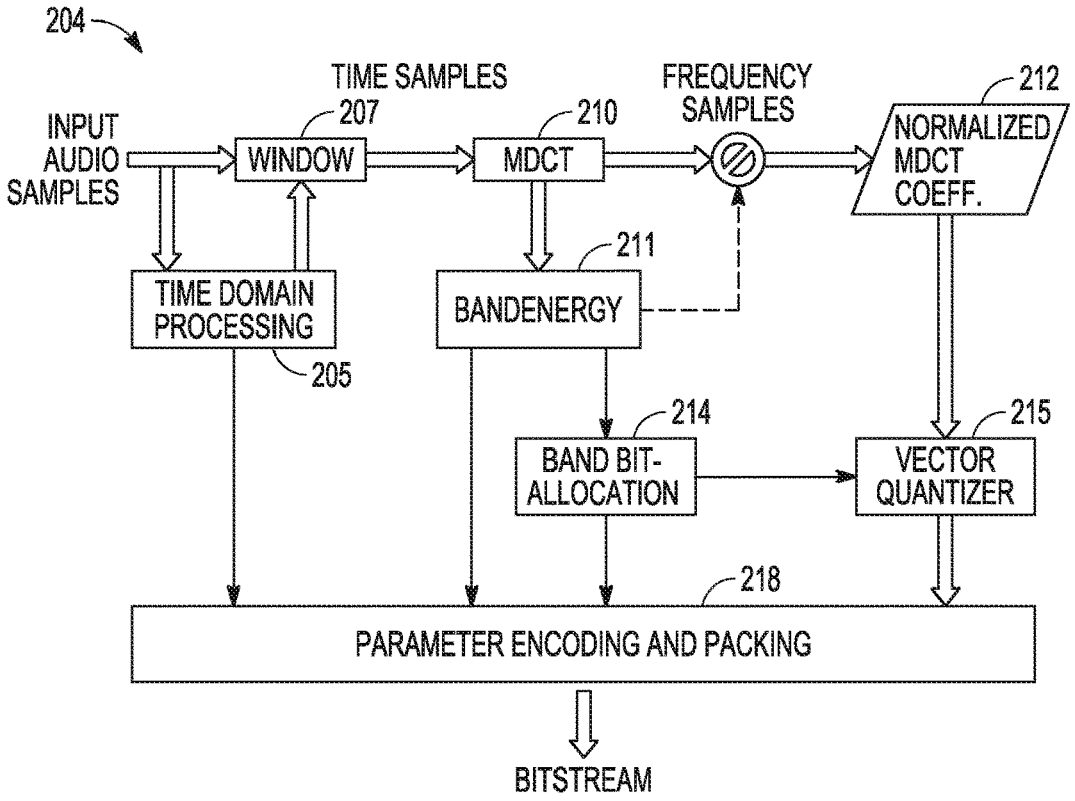
FIG. 2 (PRIOR ART)
FIG. 2 is a simplified block diagram of a typical transform-based encoder.
Figure 3A:
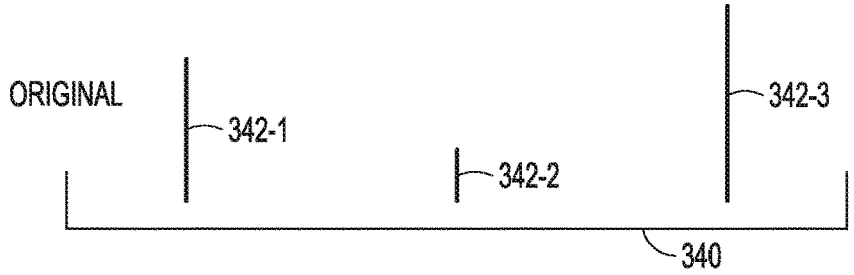
FIG. 3A illustrates a case in which a frequency band associated with an original audio signal contains three harmonics, in accordance with various embodiments.

FIG. 3A illustrates a case in which a frequency band 340 associated with an original audio signal contains three harmonics 342-1, 342-2, and 342-3. In this case in which three harmonics (frequency coefficients) of an original audio signal are captured in frequency band 340, three harmonics 342-1, 342-2, and 342-3 include a strong harmonic 342-3, which is a harmonic having a relatively high amplitude, and a small harmonic 342-2, which is a harmonic having a small amplitude in comparison to the amplitude of the strong harmonic. In such a case, there may be a disproportionate allocation of pulse to the coefficients. This is due to the fact that a maximum-SNR criteria can cause the VQ to allocate pulses to the strongest valued coefficients first, before assigning the remaining pulses to the lower valued coefficients (lower amplitude ones). In case of a scarcity of pulses, which occurs in low bitrates, it is likely that the smallest harmonic coefficient will not get any pulses assigned, and thus be missed out completely in the decoded signal. Due to the dynamic nature of the systems, the allocation as well as the amplitude of the coefficients can change between frames. Thus, in some frames, the weak harmonics may barely get coded with a pulse, while in others they don't get any coding with any pulse.

Figure 3B:
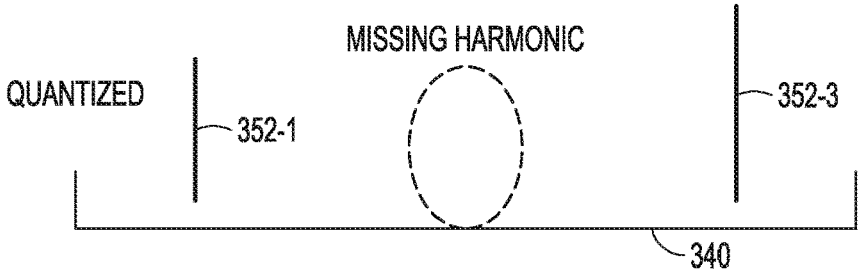
FIG. 3B shows quantized frequency coefficients in the frequency band corresponding to the original frequency coefficients of FIG. 3A, in accordance with various embodiments.

FIG. 3B shows quantized frequency coefficients 352-1 and 352-3 in frequency band 340 corresponding to the original frequency coefficients 342-1 and 342-3 of FIG. 3A, which harmonics are quantized. In this instance, since original frequency coefficient 342-2 is the smallest in amplitude, it did not get assigned any pulses as all the available pulses were used on the higher amplitude coefficients and none is left, and the set of quantized coefficients is missing a coefficient associated with small harmonic 342-2 of FIG. 3A. The result can be a lot more aggravated fluctuation in time.

Figure 4:
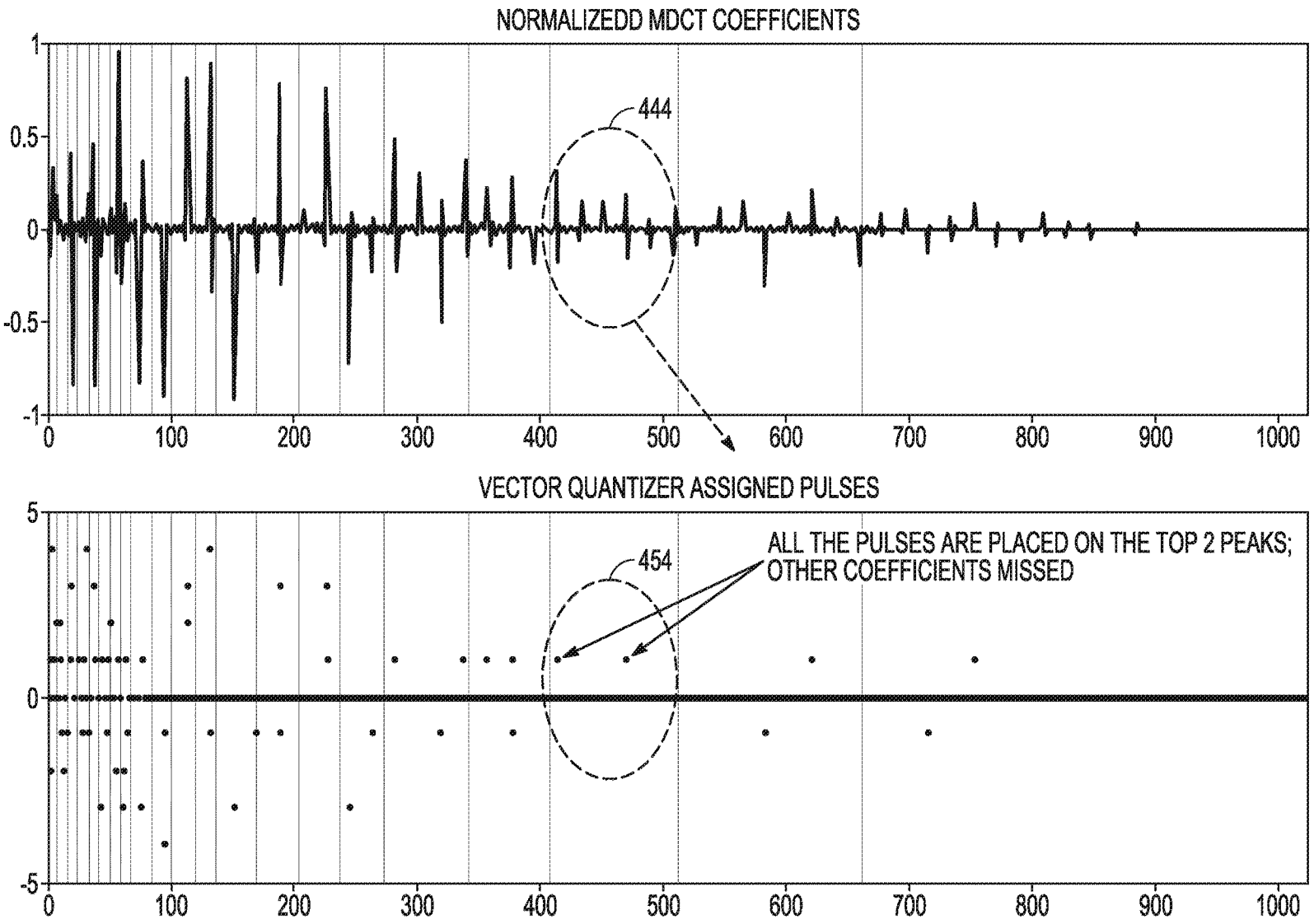
FIG. 4 illustrates an example of an assignment of pulses to various coefficients in a signal frame by a vector quantizer, in accordance with various embodiments.

FIG. 4 illustrates an example of an assignment of pulses to various coefficients in a signal frame by a vector quantizer. In region 444 on one time interval, there are several normalized MDCT coefficients. In region 454 of the same time interval, there are two vector quantizer assigned pulses. The vector quantizer places all the pulses on top two peaks in region 544. No pulses are placed with the other coefficients. These other coefficients are missed.

When listening to a complex harmonic signal, for instance a single note being played on an instrument, one tends to hear the combined sound and not individual harmonics. However, human hearing is sensitive to a break or a distortion in the harmonic structure. If one or two of these harmonics are missing, the combined sound will be perceived differently. If one of these harmonics appears and disappear in time, individuals will perceive the missing or change in energy during the corresponding time intervals. When listening to a signal having harmonics that were occasionally missed during quantization, the missing harmonics, which are broken harmonics, translate into perceived artifacts.

In various embodiments, in harmonic signal coding systems and methods, spectral weights can be applied to frequency coefficients prior to VQ in order to change the relative strength between the tonal peaks: namely de-emphasize the stronger peaks, which are high tonal peaks, relative to the weaker peaks. The frequency coefficients may be normalized frequency coefficients. This spectral weighting can be performed in such a way to ensure that the weaker peaks have a better chance of getting some of the quantization pulses and not get completely wiped out. Such spectral weights can be applied to MDCT coefficients for an audio signal prior to VQ in a manner such that smaller harmonic peaks among a set of harmonic peaks are not missed by the VQ. This utilization of these spectral weights effectively shapes the quantization noise by redistributing more noise under the large signal peaks (high peaks) where such noise is less audible and less noise under the weak signal components (the weaker harmonic peaks).

Novel features of such systems and methods can include a perceptual-based weighting technique that applies spectral weights to either: (a) frequency coefficients prior to VQ encoding; or (b) the error computed inside the VQ. The VQ can use this spectral weight as a perceptual error weighting while computing its SNR criteria. These techniques can be performed in a manner to emphasize the weak harmonics and de-emphasize the strong harmonics in a given band of the audio signal. The resulting effect is a better preservation of weak-yet-perceptually important frequency components in a low bitrate system. In addition, another novel feature includes the computation of a weighting curve, which may be derived from a spectral envelop and perceptual measures.

Harmonic signal coding systems and methods, as taught herein, can be realized in a number of different embodiments. In various embodiments, processing can be performed only on a encoder side of a system, which does not take any bandwidth or processing power away from the decoder. In some embodiments, the output of an encoder can be sent in a bitstream without sending side information to transmit temporal and spectral properties associated with harmonics of the audio signal to allow a decoder to recreate them. Intelligent weighting of spectral error can be used in order to improve the perceptual performance in a low bitrate system such that the output of an encoder can be sent in a bitstream without sending side information to transmit temporal and spectral properties associated with harmonics of the audio signal. In other embodiments, side information about how a weighting curve was computed for an audio signal can be included in the bitstream to yield an even improved coding gain.

Figure 5:
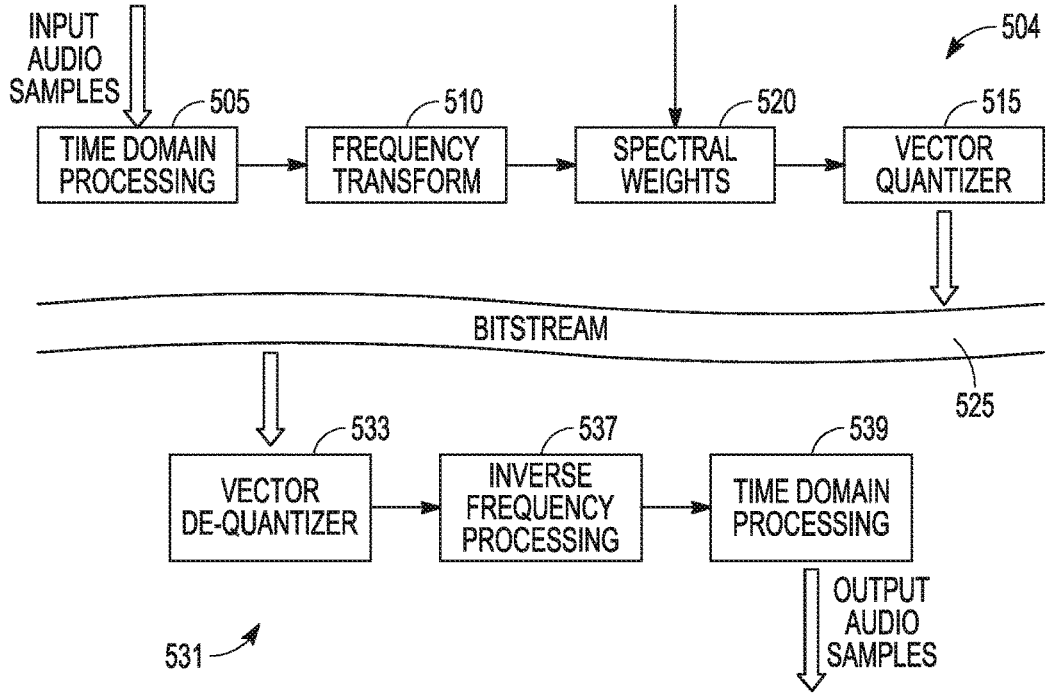
FIG. 5 is a representation of an example processing using transform-based audio codecs applying spectral weights in an encoder, in accordance with various embodiments.

FIG. 5 is a representation of an embodiment of an example processing using transform-based audio codecs applying spectral weights in an encoder 504. Input audio samples are provided to an audio encoder 504 for time domain processing 505, which provides an input for a frequency transform 510. Spectral weights 520 can be generated to operate with results of frequency transform 510. Spectral weights 520 can be realized as perceptual weights. Application of spectral weights 520 with the results of frequency transform 510 can be used in a vector quantizer 515 to generate quantized coefficients. Pulses assigned to these quantized coefficients are packed into a bitstream 525 for transport to an audio decoder 531. The transport can be conducted over a communication network. Audio decoder 531 receives input from bitstream 525 and provides the input to a vector de-quantizer 533 that provides an input to an inverse frequency processing 537. Inverse frequency processing 537 provides a time domain signal for time domain processing 539. For MDCT coefficients used for vector quantizer 515, the inverse frequency processing can be an inverse modified discrete cosine transform (IMCDT). Time domain processing 539 outputs audio samples representing the audio samples input to encoder 504 that are output from decoder 531 for use by audio devices. In various embodiments, generating and using spectral weights only in encoder 504 can be implemented, which would not provide additional equipment overhead for processing in decoder 531.

Figure 6:
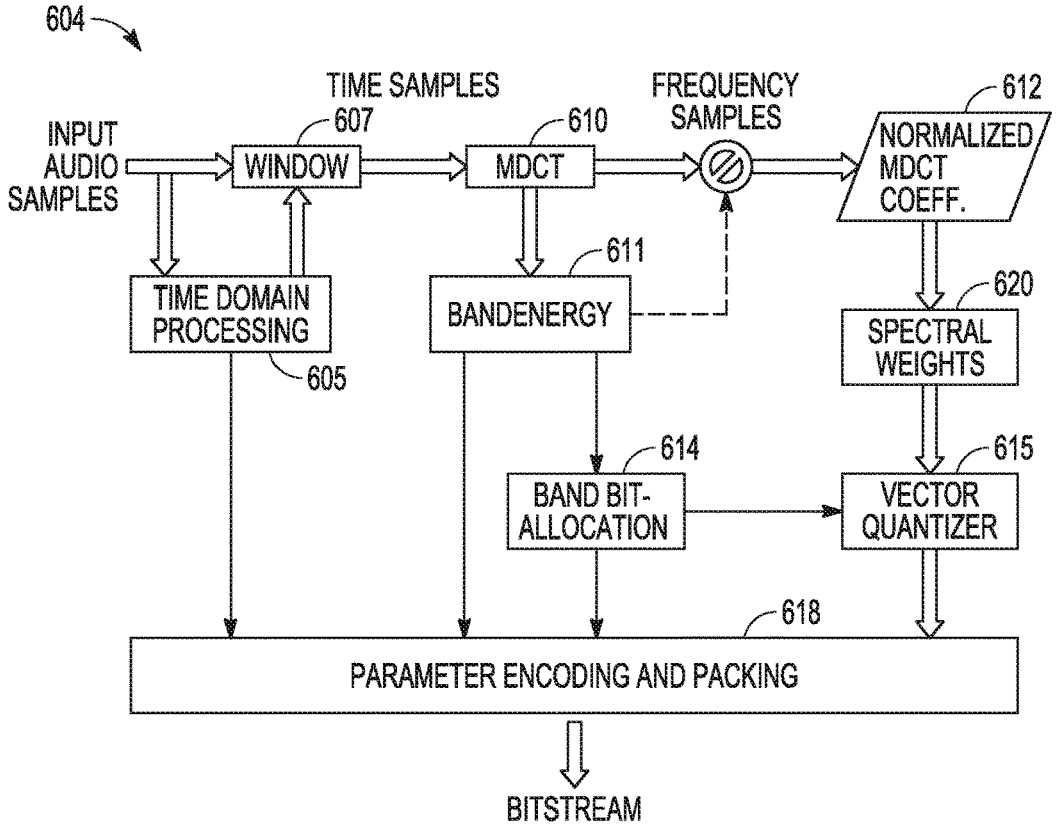
FIG. 6 is a block diagram of an example transform-based encoder in which spectral weights are applied with respect to frequency coefficients in the encoder, in accordance with various embodiments.

FIG. 6 is a block diagram of an embodiment of an example transform-based encoder 604 in which spectral weights are applied with respect to frequency coefficients in encoder 604. Encoder 604 includes a number of operational units that can be realized as a combination of communication hardware and processing hardware to encode audio signals into a bitstream for transmission to a device having a decoder to decode the encoded audio signals to generate a signal representing the original audio signal received by encoder 604. An audio signal can be received as input audio samples by encoder 604, and an operational unit can perform time domain processing 605 and another operational unit can provide a window 607 to a frame of time samples of the input audio samples. Time samples from the window 607 can be provided for an operational unit to apply MDCT 610 to provide frequency samples. A band energy unit 611 can be used to provide band boundaries to divide the MDCT spectrum into bands and/or subbands.

An operational unit to generate normalized MDCT coefficients 612 from the frequency samples provides input to an operational unit for spectral weights 620. Spectral weights 620 can be generated to operate with results of operational unit to generate normalized MDCT coefficients 612. Spectral weights 620 can be realized as perceptual weights. Application of spectral weights 620 with results of operational unit to generate normalized MDCT coefficients 612 can be used in a vector quantizer 615 to generate quantized coefficients. Vector quantizer 615 can assign pulses to selected MDCT coefficients modified by application of spectral weights 620. Vector quantizer 615 uses input from an operation unit for band bit allocation 614 that allocates bits to various bands using input from band energy unit 611. Vector quantizer 615 outputs pulses for representing the input audio samples received by encoder 604 to an operational unit for parameter encoding and packing 618. Parameters from operation associated with each of time domain processing 605, band energy unit 611, and band bit allocated 614 are provided to the operational unit for parameter encoding and packing 618. These parameters can be encoded and packed with the output of vector quantizer 615 into a bitstream for transmission from encoder 604.

In various embodiments, the spectral weights used in the quantization process of a vector quantizer, such as vector quantizer 615, can be applied to the frequency transform coefficients prior to being operated on vector quantizer 615. The frequency transform coefficients modified by the spectral weights can be used in the computation of error in the processing by vector quantizer 615. Namely, the spectral weighted frequency transform coefficients can be used as candidates for assigning pulses. Vector quantizer 615 can execute a decision to assign pulses to candidate coefficients based on computing a quantization SNR for each of the candidates. The candidate coefficient that maximizes this SNR can be selected. This process can be conducted in a search loop, in which vector quantizer 615 computes the following:

$$\text{Error(bin)} = (OriginalBin - QuantizedBin)^2$$

$$SNR(\text{band}) = \frac{\sum_{bin} [OriginalMagnitude(\text{bin})]^2}{\sum_{bin} [\text{Error(bin)}]^2},$$

where band refers to a band of a set of one or more bands into which the MDCT spectrum is divided and bin refers to a frequency in a given band, where the given band can include a number of frequencies. A bin can also be called a frequency bin. For a given bin, OriginalBin is the amplitude of the given bin before quantization and before applying a spectral weight, and QuantizedBin is the amplitude of the given after quantization. The QuantizedBin can include application of the spectral weight.

In various embodiments, the spectral weights can be used by application of the spectral weights inside a vector quantizer, such as vector quantizer 615. Rather than applying the spectral weights to frequency transform coefficients prior to being operated on the vector quantizer, spectral weights can be applied to an error to generate a weighted error. The error, the spectral weight, and the weighted error can be generated as a function of bin to be used in the determination of a SNR of a band according to:

$$\text{Error(bin)} = (OriginalBin - QuantizedBin)^2$$

$$WeightedError(\text{bin}) = SpectralWeight(\text{bin}) \times \text{Error(bin)}$$

$$SNR(\text{band}) = \frac{\sum_{bin} [OriginalMagnitude(\text{bin})]^2}{\sum_{bin} [WeightedError(\text{bin})]^2}$$

The weight curve can be derived from a spectral envelop of the MDCT coefficients and various other perceptual measures. An example of such a curve is shown in FIG. 7B.

Figure 7A:
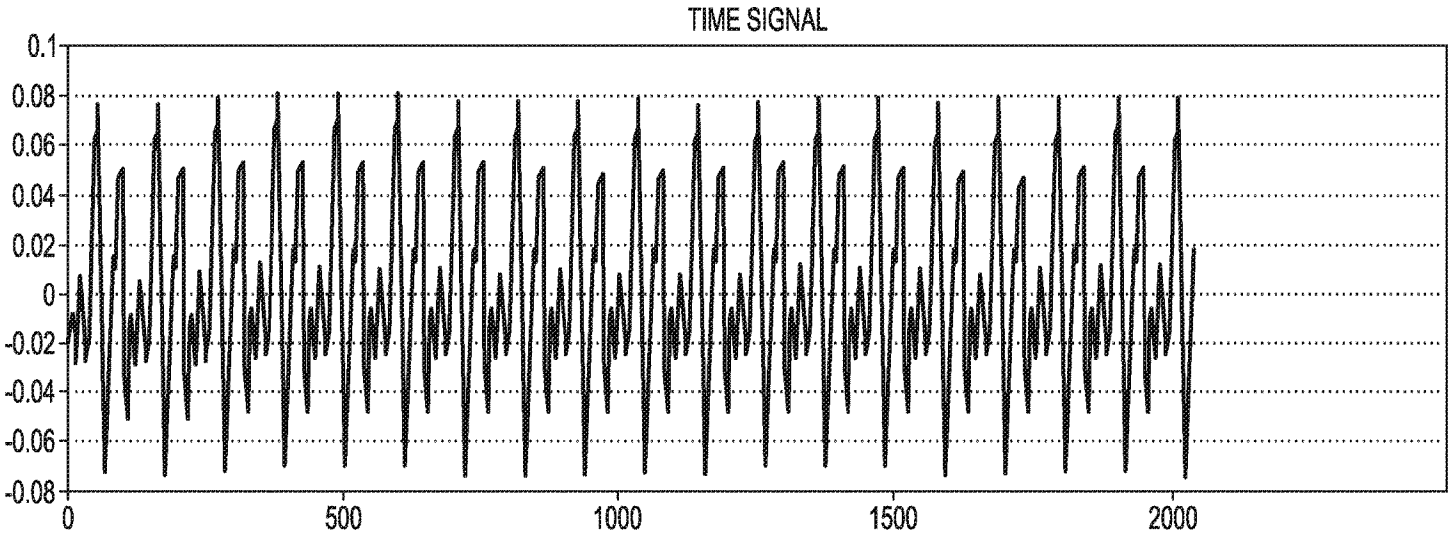
FIGS. 7A and 7B illustrate an example of a spectral weight curve applied to a harmonic segment of an audio signal, in accordance with various embodiments.
Figure 7B:
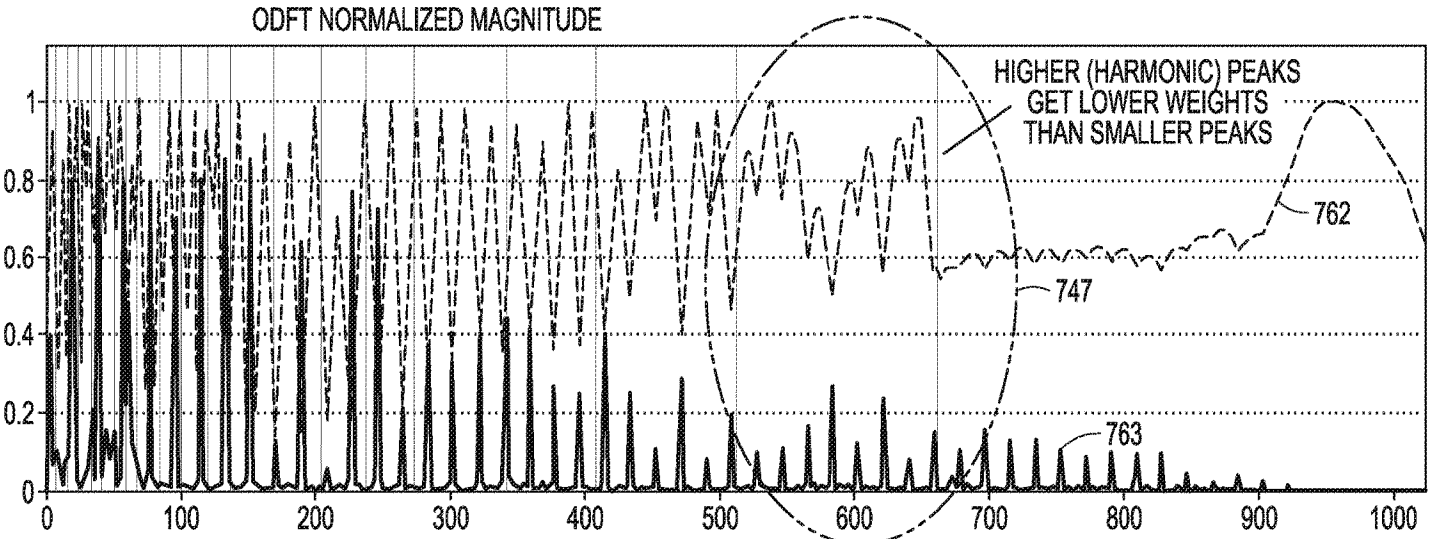

FIGS. 7A and 7B illustrate an example of a spectral weight curve applied to a harmonic segment of an audio signal. FIG. 7A shows a time signal of one frame. FIG. 7B shows odd discrete Fourier transform (ODFT) magnitude of the time signal of FIG. 7A. In FIG. 7B, a spectral weighting curve 762 is shown for magnitude peaks 761. As shown in region 747, higher (harmonic) peaks get lower weights than smaller peaks.

A weight curve can be derived as a function of a number of metrics from encoding stages. For example, a spectrum envelop can be computed from smoothing (i.e. lowpass filtering) the magnitude spectrum. Smoothing can be realized, for example, by low pass filtering. A tonality measure of the various frequency coefficients can be computed using various methods. Tonality measures the relative strength of the tones in a signal compared to the overall signal. The tonality measure can be used to determine whether a frequency bin is a harmonic peak or a noise-like component. That is, the tonality measure can be used in order to discriminate harmonic peaks from the rest of the peaks generated. A noise-to-mask ratio (NMR) in various bands can be computed. The NMR measure can be used to determine whether the quantization noise from missing certain harmonics from the spectrum will be audible or not. The NMR measure can be used to apply a weight only in places where the quantization noise is audible. In bands where the NMR is relatively very high, weighting is applied in order to reduce the artifact.

In various embodiment, an equation for the spectral weights to apply in a given band of the MDCT spectrum given by:

$$SpectralWeight|_{band,bin} = \left(\frac{VerySmoothedSpectrum}{LessSmoothedSpectrum}\right)^{\alpha \cdot BinTonality(bin) \cdot BandTonality(band)}.$$

The term $\alpha$ is an aggressivity factor in the range of [0, 1]. It can be can be derived as a function of bin NMR in the band. The aggressivity factor can be made a function of the variance of the bin NMR in a given band, for example as $$\alpha = \alpha_1 + \alpha_2 \, \text{var}(\text{bin_nmr})_{dB},$$

where $\alpha_1$ and $\alpha_2$ are empirically determined parameters. Bin Tonality (bin) is a measure of the tonality of a given frequency bin in a range, which can be taken to be a range of [0, 1]. It is a measure of the tonal value of each coefficient in the spectrum. There are various ways to estimate tonality, for instance, using the predictive model described in the MPEG Model II. Band Tonality (band) is measure of the tonal value of each band of the spectrum, which can be taken to be a range of [0, 1]. There are various ways to estimate tonality, for instance, using the predictive model described in the MPEG Model II. Very Smoothed Spectrum and Less Smoothed Spectrum refer to varying degree of smoothing of a transform magnitude spectrum such as a fast Fourier transform (FFT) magnitude spectrum. Smoothing here can be achieved by low pass filtering or averaging the magnitude values in the forward and backward direction. These two types of smoothed versions can be achieved by controlling the averaging parameter.

Computation of a weight curve and application with respect to frequency coefficients can be implemented using two encoding calls in a processing unit with one or more processors executing instructions stored in a memory storage device. At the encoding stages, an incoming audio signal is divided into frames, and each frame is encoded twice. The first encoding is a simulation or tentative encode used to compute various metrics. This operation provides signal analysis and is used to encode and then decode a frame of the signal, from which a number of measures are computed such as SNR and NMR, which can be used to compute the VQ weighting curve. The second encoding is the actual encode and uses the measures of the first encode to apply weights with respect to frequency components, such as MDCT components, and make final decisions on bit allocation. The results of this second pass generates the quantized parameters that are placed in the bitstream.

Figure 8:
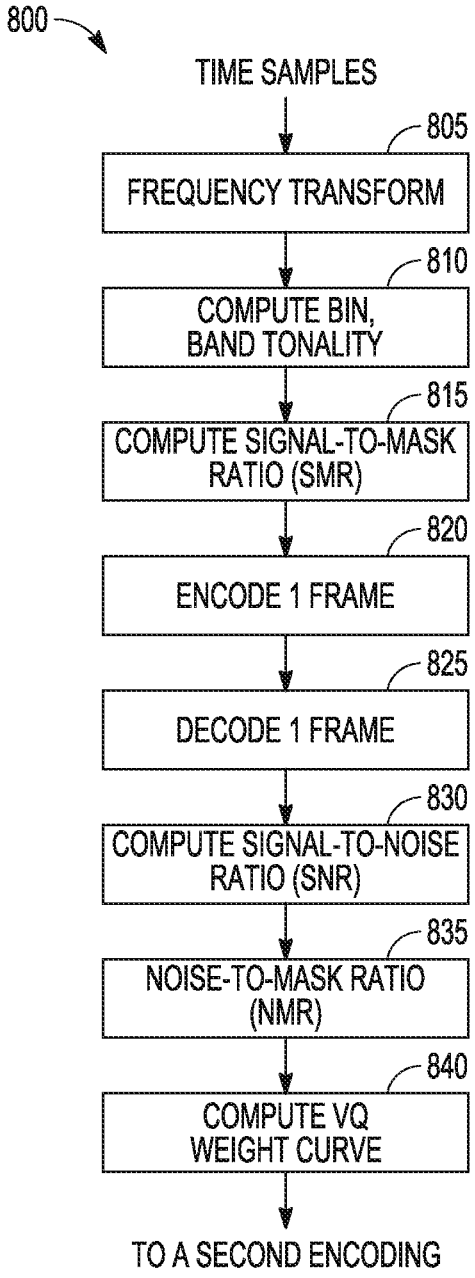
FIG. 8 is a flow diagram of features of an example operations carried out during a tentative encoding stage to a vector quantization weighting curve for spectral weights, in accordance with various embodiments.

FIG. 8 is a flow diagram of features of an embodiment of an example operations 800 carried out during a tentative encoding stage to a VQ weighting curve for spectral weights. At operation 805, a frequency transform of time signals is performed. This operation can include applying a window to a frame of time samples and computing a Fourier transform in order to generate a spectrum representation of the frame. At operation 810, bin tonality and band tonality are computed. The measure of tonality for each frequency component is computed. Similarly, the measure of the tonality of the various frequency bands is also computed. There are a number of ways to compute the tonality of frequency components. See, for example, Annex D of MP3 ITU-11172-3; M. Kulesza, A. Czyzewski, "Tonality Estimation and Frequency Tracking of Modulated Tonal Components," JAES Volume 57 Issue 4 pp. 221-236; April 2009; and M. Kulesza, A. Czyzewski. "Frequency based criterion for distinguishing tonal and noisy spectral components," International Journal of Computer Science and Security, Volume (4): Issue (1), pp. 1-16, March 2010. The values of the tonality are typically in the range of [0, 1] and indicate whether a given frequency bin (component) corresponds to a tonal (sinusoidal) signal or a noise-like signal. At operation 815, a signal-to-mask ratio (SMR) is computed. This step computes the masking curve across the spectrum based on a model, for instance, based on a psycho-acoustic model such as in Annex D of MP3 ITU-11172-3.

At operation 820, one frame is encoded. The encoding here can involve applying various operations of the encoder, which include any time-domain processing, computing MDCT coefficients, determining bit allocation for the various bands, applying any time-frequency shaping or splitting, and using vector quantization to quantize the MDCT coefficients. At operation 825, the one frame is decoded. This step can involve applying a partial or full decoding operation on the frame that was just encoded. This partial or full decoding includes applying an inverse vector quantization and other operations to recover the MDCT coefficients. These operations can be used to compute various measures such as the signal-to-noise ratio.

At operation 830, the signal over noise ratio (SNR) between the original MDCT coefficients (prior to encoding) and the decoded MDCT coefficients (after quantization/dequantization) is computed as:

$$SNR(\text{bin}) = 10\log_{10}\left\{\frac{[OriginalMDCT(\text{bin})]^2}{|DecodedMDCT(\text{bin}) - OriginalMDCT(\text{bin})|^2}\right\}.$$

At operation 835, the NMR at every frequency bin is computed using the SMR and the SNR as $$NMR(\text{bin}) = \frac{SMR(\text{bin})}{SNR(\text{bin})}.$$

At operation 840, the VQ weighting curve is computed from the entities computed above, where the weight curve can be deduced as $$SpectralWeight|_{band,bin} = \left(\frac{VerySmoothedSpectrum}{LessSmoothedSpectrum}\right)^{\alpha\cdot BinTonality(bin)\cdot BandTonality(band)}$$

As noted, Very Smoothed Spectrum and Less Smoothed Spectrum refer to varying degree of smoothing of the FFT magnitude spectrum, where smoothing here can be achieved by low pass filtering or averaging the magnitude values in the forward and backward direction. Controlling the averaging parameter achieves these two flavors of smoothed versions. An example of an autoregressive averaging applied to the magnitude spectrum may be implemented as follows:

For bin=[start_bin:end_bin]

$$\text{Avg}|_{band,bin}=\lambda\cdot\text{Avg}|_{band,min-1}+(1-\lambda)\cdot|X(\text{bin})|$$

$$\text{SmoothedSpectru}|_{band,bin}=\text{Avg}|_{band,bin},$$

where λ is a constant used for exponential averaging that varies between 0.0 and 1.0, and X(bin) is a magnitude spectrum value at a given bin.

Once the weights are computed in the first encoding pass, a second encoding call is executed to apply the weights. The application of the weights can be performed based on a number of conditions in order to ensure they are being applied only when needed. In embodiments in which spectral weights are only applied at the encoder, the application of the spectral weights can be a matter of a tradeoff, which may be useful in low bitrate situations. Without the weighting, the VQ would place all available pulses at the high peaks of the spectrum, and the smaller peaks are completely missed, that is, not recovered at the decoder. With the weighting scheme, some pulses go on the high peaks, providing more likelihood of some pulses going on the weaker peaks, thus better preserving the harmonic structure of the signal. Spectral weights can be generated to perceptually shape a vector quantizer error; where the weights are derived in a compromise between altering the spectrum (or timber) of the audio signal and reducing the artifacts caused by the missing quantized coefficients when no weights are used.

Figure 9:
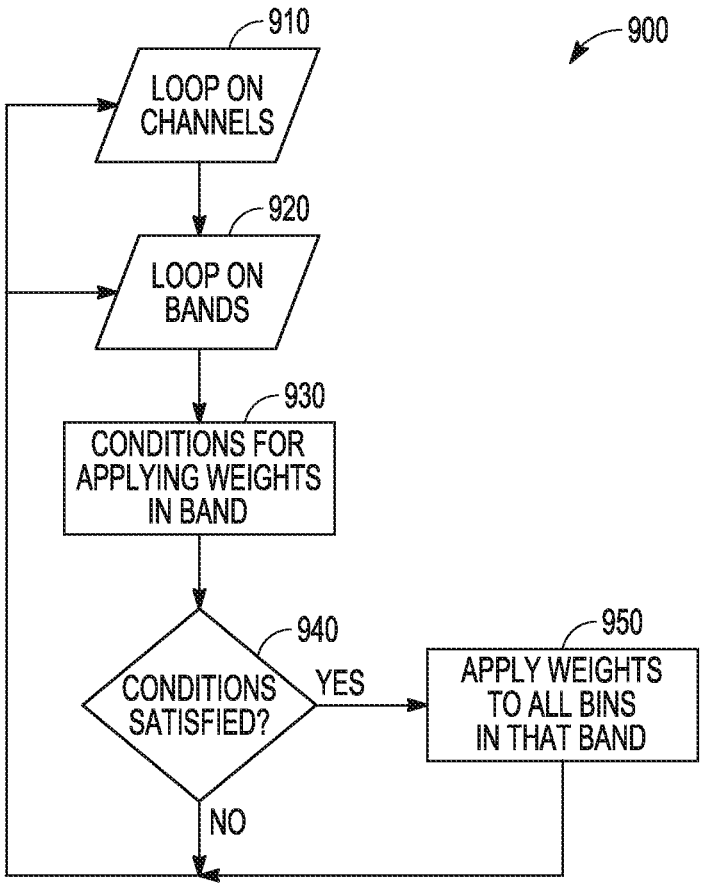
FIG. 9 is a flow diagram of features of an example method for applying weights to the coefficients of a given band, in accordance with various embodiments.

FIG. 9 is a flow diagram of features of an embodiment of an example method 900 for applying weights to the coefficients of a given band. The input signals to an encoder can be signals provided in different channels to the encoder. The weights can be applied to the normalized MDCT coefficients in each frequency band and each channel. At 910, the process for application of weights can loop through each channel. At 920, for each channel, the process for application of weights can loop through band within the channel.

At 930, for a given band in a given channel, a number of conditions can be checked to determine if the weights are to be applied. Condition one can include whether the average NMR of the band is greater than a preset band NMR threshold. A condition two can include whether the frame NMR, averaged over all bands and channels, is greater than a preset frame NMR threshold. A condition three can include whether the number of VQ pulses in that band are less than the number of tonal bins in that band. Conditions one and two indicate that the quantization noise is audible enough that a compromise is needed, which can be realized by application of spectral weights. Condition three indicates a scarcity of bits, whereby the vector quantizer of the encoder does not have enough pulses to capture all the coefficients.

At 940, a determination is made as to whether the conditions are satisfied. If the conditions are not satisfied, the process loops to the next channel and next band. If the conditions at 940 are satisfied, at 950, a weight is applied to all bins in the current band in the current loop.

A simulation was conducted. A database consisting of a total of 370 audio files of various musical recordings sampled at 48 kHz was used. The 370 files were between 10 and 14 seconds each in duration and were distributed across channel formats: mono (100 files) stereo (100 files), 5.1 (70 files) 7.1 (50 files), and 11.1 (50 files). Different bit rates were used in the encoding, varying from 12 kbps to 192 kbps per channel.

Figure 10:
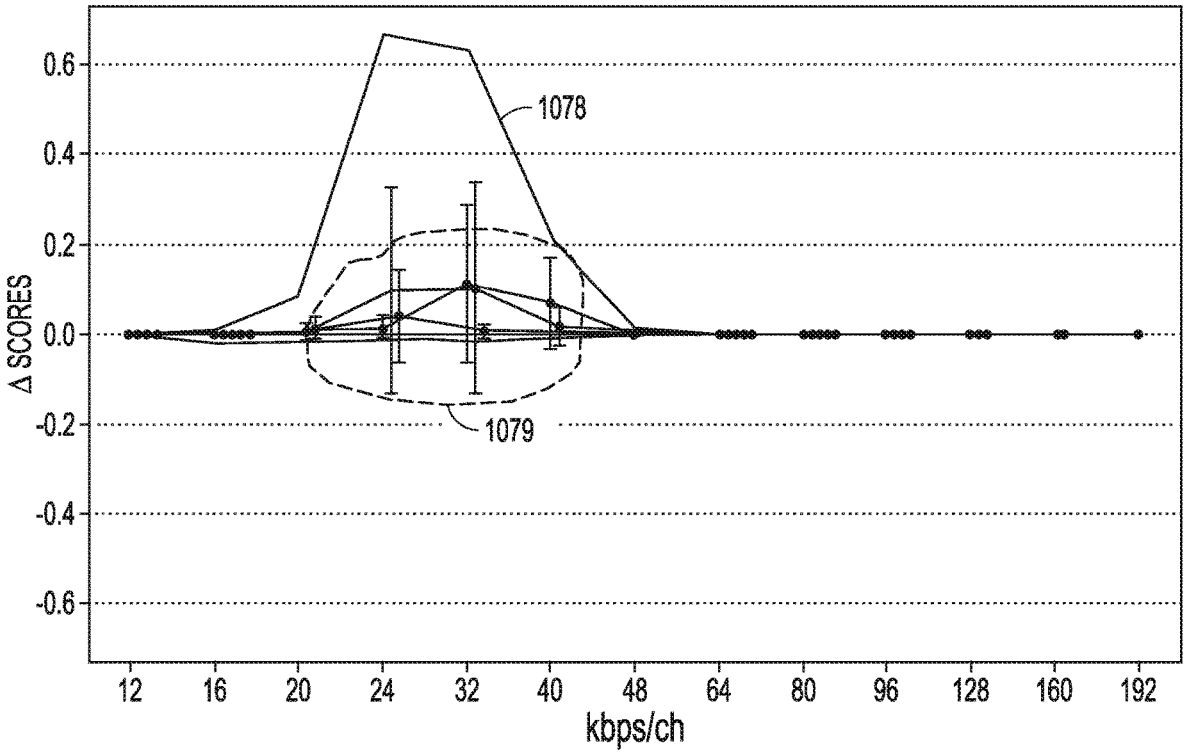
FIG. 10 shows a delta perceptual evaluation of audio quality scores between using spectral weights and not using weights, in accordance with various embodiments.

Coding and decoding were applied to all the files in the database for all the ranges of the bit rates, with and without the spectral weight. Perceptual evaluation of audio quality (PEAQ) was used in evaluating the measurements. PEAQ is a standardized algorithm for objectively measuring perceived audio quality. The PEAQ scores were evaluated for each and compared. FIG. 10 shows delta (Δ) PEAQ scores between using spectral weights and not using weights, where DeltaPEAQ =PEAQ(WithWeights)−PEAQ(No-Weights).

PEAQ values model the mean opinion scores which cover the scale of 1 (bad) to 5 (excellent , or transparent). Averages across all files is shown in region 1079, with positive outliers indicated by 1078. The curves indicate PEAQ score improvement. The simulation shows that using an implementation, as taught herein, there is an improvement in low bitrate encoders.

In various embodiments, an audio encoding system can comprise: a processor; a frequency transformation unit to represent a windowed signal in the frequency domain; band boundaries according to a perceptual scale; a vector quantization (VQ) unit to quantize frequency transform coefficients of a frame of the windowed signal to he encoded; a memory device storing instructions executable by the processor, the instructions being executable by the processor to perform a method for encoding an audio signal, the method comprising: a perceptual-based weighting technique that applies spectral weights to at least one of: (a) the frequency transform coefficients prior to VQ encoding; and, (b) the error computed inside the VQ; and an encoded signal containing the quantized frequency transform coefficients, and where the encoded signal is a representation of the audio signal.

Variations of such a system or similar systems can further comprise applying the perceptual-based weighting technique in a manner to emphasize the weak harmonics and de-emphasize the strong harmonics in a given band, in such a way that the resulting effect is a better preservation of the weak-yet-perceptually important frequency components in low bitrate. Variations of such an audio encoding system or similar systems can further comprise computing the perceptual weights based on the bin tonality, band tonality, and NMRs of the bins and bands. Variations of such an audio encoding system or similar systems can further comprise applying the weights only to the bands whose noise-to-mask ratio is above a given threshold. Variations of such an audio encoding system or similar systems can further comprise computing the weights using the following equation:

$$SpectralWeight_{band,bin} = \left(\frac{VerySmoothedSpectrum}{LessSmoothedSpectrum}\right)^{\alpha \cdot BinTonality(bin) \cdot BandTonality(band)}$$

Figure 11:
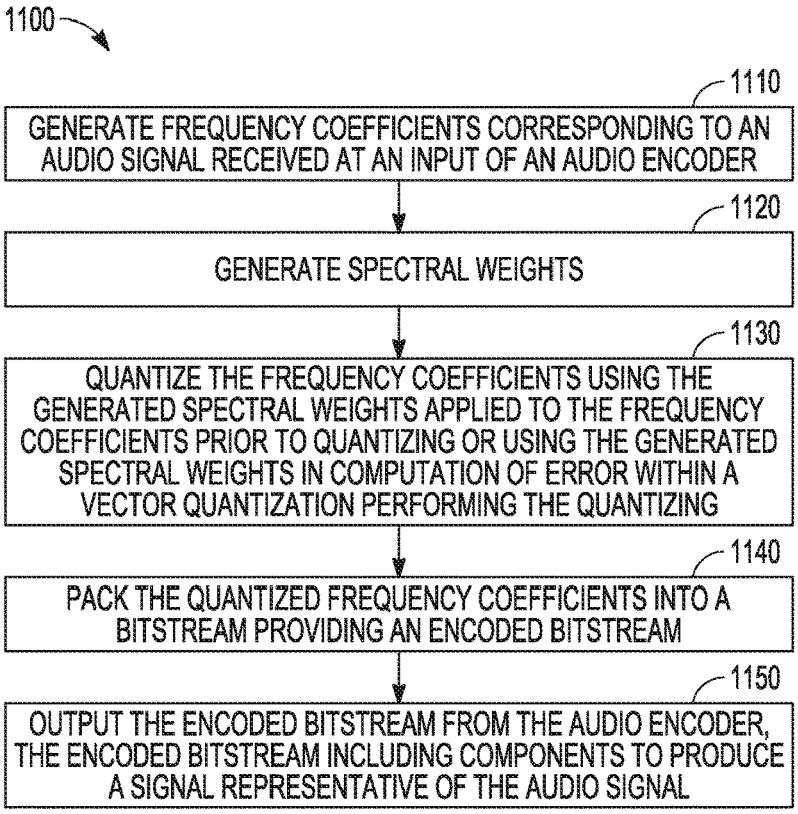
FIG. 11 is a flow diagram of features of an example method of encoding an audio signal, in accordance with various embodiments.

FIG. 11 is a flow diagram of features of an embodiment of an example method 1100 of encoding an audio signal. Method 1100 can be implemented as a process-implemented method using a memory storage device comprising instructions and one or more processors that execute instructions of the memory storage. At 1110, frequency coefficients corresponding to an audio signal received at an input of an audio encoder are generated. Generating frequency coefficients corresponding to the audio signal can include applying a window to a frame of time samples of the audio signal and computing a frequency transform on the frame of time samples to generate a spectrum representation of the frame. The frequency transform can include a Fourier transform, a MDCT, ODFT, or other frequency transform.

At 1120, spectral weights are generated. The spectral weights can be generated to perceptually shape a vector quantizer error, where the weights can be derived in a compromise between altering a spectrum of the audio signal and reducing artifacts caused by missing quantized coefficients corresponding to using quantized coefficients without weights. With the audio signal having been transformed to a signal spectrum with the signal spectrum divided into a number of frequency bands having a number of bins, generating spectral weights can include generating a spectral weight per frequency band and bin by: generating two smoothed spectrums, the two smoothed spectrums being of varying degrees of smoothing magnitude of the signal spectrum; determining a ratio of the two smoothed spectrums; and adjusting the ratio using an aggressivity factor, a bin tonality, and a band tonality. Generating the spectral weights can include computing a vector quantization weighting curve, performed in a simulation encoding, including: computing bin tonality and band tonality associated with the spectrum representation; generating a SMR, the SMR associated with a masking curve across the spectrum representation; encoding the frame to generate simulated quantized frequency coefficients; decoding the frame to recover the simulated quantized frequency coefficients; computing a SNR between original frequency coefficients, determined prior to encoding the frame, and the recovered simulated quantized frequency coefficients; computing a NMR as a ratio of the SMR and the SNR; and computing the vector quantization weighting curve using the bin tonality, the band tonality, the SNR, and the NMR, where the encoding, decoding, and SNR computation are carried out in a given frequency domain, and the SMR and the NMR computations are carried out in the same frequency domain or in a different frequency domain. Method 1100 or methods similar to method 1100 can include normalizing the generated frequency coefficients in one or more frequency bands and applying the spectral weights to the normalized generated frequency coefficients such that tonal peaks of high amplitude relative to tonal peaks of lower amplitude in a given frequency band are de-emphasized prior to the quantizing.

At 1130, the frequency coefficients are quantized using the generated spectral weights applied to the frequency coefficients prior to quantizing or using the generated spectral weights in computation of error within a vector quantization performing the quantizing. Quantizing the frequency coefficients using the generated spectral weights in the computation of error can include using the spectral weights in computing a signal-to-noise ratio per frequency band, the audio signal having been transformed to a signal spectrum with the signal spectrum divided into a number of frequency bands, and maximizing the signal-to-noise ratio in assignment of pulses to frequency coefficients in each frequency band. With the audio signal having been transformed to a signal spectrum with the signal spectrum divided into a number of frequency bands having a number of bins, using the generated spectral weights can include applying the generated spectral weights to all bins in a band in response to satisfying a condition, the condition including an average noise-to-mask ratio of the band being greater than a threshold for a band noise-to-mask ratio.

At 1140, the quantized frequency coefficients are packed into a bitstream providing an encoded bitstream. At method 1150, the encoded bitstream is output from the audio encoder, the encoded bitstream including components to produce a signal representative of the audio signal.

In various embodiments, a non-transitory machine-readable storage device, such as computer-readable non-transitory media, can comprise instructions stored thereon, which, when executed by components of a machine, cause the machine to perform operations, where the operations comprise one or more features similar to or identical to features of methods and techniques described with respect to method 800, method 900, method 1100, variations thereof, and/or features of other methods taught herein such as associated with FIGS. 5-9. The physical structures of such instructions may be operated on by one or more processors. For example, executing these physical structures can cause the machine to perform operations comprising operations to: generate frequency coefficients corresponding to an audio signal received at an input of an audio encoder; generate spectral weights to perceptually shape a vector quantizer error, the weights derived in a compromise between altering a spectrum of the audio signal and reducing artifacts caused by missing quantized coefficients corresponding to use of quantized coefficients without weights; quantize the frequency coefficients by use of the generated spectral weights applied to the frequency coefficients prior to the quantization or by use of the generated spectral weights in computation of error within a vector quantization that performs the quantization; pack the quantized frequency coefficients into a bitstream to provide an encoded bitstream; and output the encoded bitstream from the audio encoder, the encoded bitstream including components to produce a signal representative of the audio signal.

The operations can include operations to normalize the generated frequency coefficients in one or more frequency bands and to apply the spectral weights to the normalized generated frequency coefficients such that tonal peaks of high amplitude relative to tonal peaks of lower amplitude in a given frequency band are de-emphasized prior to the quantization. Variations of the operations can include a number of different embodiments that may be combined depending on the application of such operations and/or the architecture of systems in which such operations are implemented. Operations to quantize the frequency coefficients by use of the generated spectral weights in the computation of error include operations to: use the spectral weights in computation of a signal-to-noise ratio per frequency band, the audio signal having been transformed to a signal spectrum with the signal spectrum divided into a number of frequency bands; and maximize the signal-to-noise ratio in assignment of pulses to frequency coefficients in each frequency band.

With a transformation of the audio signal to a signal spectrum with the signal spectrum divided into a number of frequency bands having a number of bins, operations to generate the spectral weights include operations to generate a spectral weight per frequency band and bin by: generation of two smoothed spectrums, the two smoothed spectrums being of varying degrees of smoothing magnitude of the signal spectrum; determination of a ratio of the two smoothed spectrums; and adjustment of the ratio by use of an aggressivity factor, a bin tonality, and a band tonality.

Operations to generate the spectral weights can include a computation of a vector quantization weighting curve, performed in a simulation encoding, the computation including operations to: compute bin tonality and band tonality associated with a spectrum representation of a frame of time samples of the audio signal, the spectrum representation generated by a computation of a frequency transform on the frame of time samples; generate a signal-to-mask ratio (SMR), the SMR associated with a masking curve across the spectrum representation; encode the frame to generate simulated quantized frequency coefficients; decode the encoded frame to recover the simulated quantized frequency coefficients; compute a signal-over-noise ratio (SNR) between original frequency coefficients, determined prior to encoding the frame, and the recovered simulated quantized frequency coefficients; compute a noise-to-mask ratio (NMR) as a ratio of the SMR and the SNR; and compute the vector quantization weighting curve using the bin tonality, the band tonality, the SNR, and the NMR, wherein the encoding, decoding, and SNR computation are carried out in a given frequency domain, and the SMR and the NMR computations are carried out in the same frequency domain or in a different frequency domain.

Figure 12:
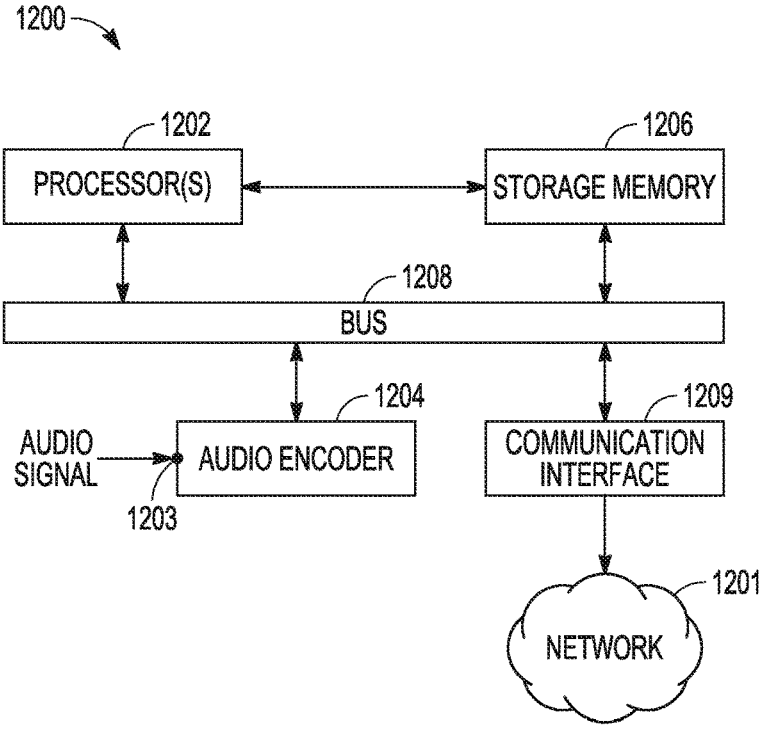
FIG. 12 is a block diagram of a system having an audio encoder, in accordance with various embodiments.

FIG. 12 is a block diagram of a system 1200 having an audio encoder 1204. System 1200 can comprise an input 1203 to audio encoder 1204 to receive an audio signal; one or more processors 1202; and a memory storage 1207 having instructions stored therein, where the instructions are executable by the one or more processors 1202 to cause audio encoder 1204 to perform operations. Encoder 1204 may be implemented as a standalone system with its own processors and memory having stored instructions. Encoder 1204 may be implemented to include software instructions in addition or integrated with the instructions of memory storage 1207. One or more processors 1202, a memory storage 1207, audio encoder 1204, and a communication interface 1209 may be coupled to a bus 1208 for intercommunication. Bus 1208 provides communication paths between and/or among various components of system 1200. Alternatively, these components of system 1200 may be interconnected individually or by a combination of individual connections and bus 1208.

The operations can include operations to: generate frequency coefficients corresponding to the audio signal; generate spectral weights to perceptually shape a vector quantizer error, the weights derived in a compromise between altering a spectrum of the audio signal and reducing artifacts caused by missing quantized coefficients corresponding to use of quantized coefficients without weights; quantize the frequency coefficients by use of the generated spectral weights applied to the frequency coefficients prior to the quantization or by use of the generated spectral weights in computation of error within a vector quantization that performs the quantization; pack the quantized frequency coefficients into a bitstream to provide an encoded bitstream; and output the encoded bitstream from the audio encoder, the encoded bitstream including components to produce a signal representative of the audio signal. Information about how a weighting curve was computed for the spectral weights for the audio signal can be included in the encoded bitstream. System 1200 can include communication interface 1209 to output the encoded bitstream. Communication interface 1209 may couple the encoded bitstream to a network 1201 for transport to a decoder. The operations can include a normalization of the generated frequency coefficients in one or more frequency bands and application of the spectral weights to the normalized generated frequency coefficients such that tonal peaks of high amplitude relative to tonal peaks of lower amplitude in a given frequency band are de-emphasized prior to the quantization.

Variations of system 1200 can include a number of different embodiments that may be combined depending on the application of such systems and/or the architecture in which such methods are implemented. In such systems, quantization of the frequency coefficients by use of the generated spectral weights in the computation of error can include: a use of the spectral weights in computation of a signal-to-noise ratio per frequency band, the audio signal having been transformed to a signal spectrum with the signal spectrum divided into a number of frequency bands; and a maximization of the signal-to-noise ratio in assignment of pulses to frequency coefficients in each frequency band.

With the audio signal having been transformed to a signal spectrum with the signal spectrum divided into a number of frequency bands having a number of bins, generation of the spectral weights can include generation of a spectral weight per frequency band and bin by: a generation of two smoothed spectrums, the two smoothed spectrums being of varying degrees of smoothing magnitude of the signal spectrum; a determination of a ratio of the two smoothed spectrums; and an adjustment of the ratio by use of an aggressivity factor, a bin tonality, and a band tonality.

In an embodiment, generation of the frequency coefficients corresponding to the audio signal can include an application of a window to a frame of time samples of the audio signal and a computation of a frequency transform on the frame of time samples to generate a spectrum representation of the frame. The frequency transform can include a Fourier transform, a MDCT, ODFT, or other frequency transform: Generation of the spectral weights can include a computation of a vector quantization weighting curve, performed in a simulation encoding, including: a computation of bin tonality and band tonality associated with the spectrum representation; a generation of a SMR ratio, the SMR associated with a masking curve across the spectrum representation; an encoding of the frame to generate simulated quantized frequency coefficients; a decoding of the frame to recover the simulated quantized frequency coefficients; a computation of a SNR between original frequency coefficients, determined prior to encoding the frame, and the recovered simulated quantized frequency coefficients; a computation of a NMR as a ratio of the SMR and the SNR; and a computation of the vector quantization weighting curve using the bin tonality, the band tonality, the SNR, and the NMR, where the encoding, decoding, and SNR computation are carried out in a given frequency domain, and the SMR and the NMR computations are carried out in the same frequency domain or in a different frequency domain.

In various embodiments, with the audio signal having been transformed to a signal spectrum with the signal spectrum divided into a number of frequency bands, where each frequency band has a number of bins, use of the generated spectral weights can include an application of the generated spectral weights to all bins in a band in response to satisfaction of a condition. The condition can include an average noise-to-mask ratio of the band being greater than a threshold for a band noise-to-mask ratio. The system can be structured such that the frequency coefficients are modified discrete cosine transform (MDCT) coefficients. Other transform coefficients may be used.

According to various embodiments, a first example system, having an audio encoder, can comprise: an input to the audio encoder to receive an audio signal; one or more processors; a memory storage having instructions stored therein, the instructions executable by the one or more processors to cause the audio encoder to perform operations to: generate frequency coefficients corresponding to the audio signal; generate spectral weights to perceptually shape a vector quantizer error, the weights derived in a compromise between altering a spectrum of the audio signal and reducing artifacts caused by missing quantized coefficients corresponding to use of quantized coefficients without weights; quantize the frequency coefficients by use of the generated spectral weights applied to the frequency coefficients prior to the quantization or by use of the generated spectral weights in computation of error within a vector quantization that performs the quantization; pack the quantized frequency coefficients into a bitstream to provide an encoded bitstream; and output the encoded bitstream from the audio encoder, the encoded bitstream including components to produce a signal representative of the audio signal.

In accordance with the preceding first example system, another implementation provides that the operations include a normalization of the generated frequency coefficients in one or more frequency bands and an application of the spectral weights to the normalized generated frequency coefficients such that tonal peaks of high amplitude relative to tonal peaks of lower amplitude in a given frequency band are de-emphasized prior to the quantization.

In any of the preceding examples in accordance with the first example system, a further implementation provides that quantization of the frequency coefficients by use of the generated spectral weights in the computation of error includes: a use of the spectral weights in computation of a signal-to-noise ratio per frequency band, the audio signal having been transformed to a signal spectrum with the signal spectrum divided into a number of frequency bands; and a maximization of the signal-to-noise ratio in assignment of pulses to frequency coefficients in each frequency band.

In any of the preceding examples in accordance with the first example system, a further implementation provides that, with the audio signal having been transformed to a signal spectrum with the signal spectrum divided into a number of frequency bands having a number of bins, generation of the spectral weights includes generation of a spectral weight per frequency band and bin by: a generation of two smoothed spectrums, the two smoothed spectrums being of varying degrees of smoothing magnitude of the signal spectrum; a determination of a ratio of the two smoothed spectrums; and an adjustment of the ratio by use of an aggressivity factor, a bin tonality, and a band tonality.

In any of the preceding examples in accordance with the first example system, a further implementation provides that generation of the frequency coefficients corresponding to the audio signal includes an application of a window to a frame of time samples of the audio signal and a computation of a frequency transform on the frame of time samples to generate a spectrum representation of the frame.

In any of the preceding examples in accordance with the first example system, a further implementation provides that generation of the spectral weights includes a computation of a vector quantization weighting curve, performed in a simulation encoding, including: a computation of bin tonality and band tonality associated with the spectrum representation; a generation of a signal-to-mask ratio (SMR), the SMR associated with a masking curve across the spectrum representation; an encoding of the frame to generate simulated quantized frequency coefficients; a decoding of the frame to recover the simulated quantized frequency coefficients; a computation of a signal-over-noise ratio (SNR) between original frequency coefficients, determined prior to encoding the frame, and the recovered simulated quantized frequency coefficients; a computation of a noise-to-mask ratio (NMR) as a ratio of the SMR and the SNR; and a computation of the vector quantization weighting curve using the bin tonality, the band tonality, the SNR, and the NMR, wherein the encoding, decoding, and SNR computation are carried out in a given frequency domain, and the SMR and the NMR computations are carried out in the same frequency domain or in a different frequency domain.

In any of the preceding examples in accordance with the first example system, a further implementation provides that, with the audio signal having been transformed to a signal spectrum with the signal spectrum divided into a number of frequency bands having a number of bins, use of the generated spectral weights includes an application of the generated spectral weights to all bins in a band in response to satisfaction of a condition, the condition including an average noise-to-mask ratio of the band being greater than a threshold for a band noise-to-mask ratio.

In any of the preceding examples in accordance with the first example system, a further implementation provides that information about how a weighting curve was computed for the spectral weights for the audio signal is included in the encoded bitstream.

According to various embodiments, a first example processor-implemented method can comprise: generating frequency coefficients corresponding to an audio signal received at an input of an audio encoder; generating spectral weights to perceptually shape a vector quantizer error, the weights derived in a compromise between altering a spectrum of the audio signal and reducing artifacts caused by missing quantized coefficients corresponding to using quantized. coefficients without weights; quantizing the frequency coefficients using the generated spectral weights applied to the frequency coefficients prior to quantizing or using the generated spectral weights in computation of error within a vector quantization performing the quantizing; packing the quantized frequency coefficients into a bitstream providing an encoded bitstream; and outputting the encoded bitstream from the audio encoder, the encoded bitstream including components to produce a signal representative of the audio signal.

In accordance with the preceding first example processor-implemented method, another implementation provides that the processor-implemented method includes normalizing the generated frequency coefficients in one or more frequency bands and applying the spectral weights to the normalized generated frequency coefficients such that tonal peaks of high amplitude relative to tonal peaks of lower amplitude in a given frequency band are de-emphasized prior to the quantizing.

In any of the preceding examples in accordance with the preceding first example processor-implemented method, a further implementation provides that quantizing the frequency coefficients using the generated spectral weights in the computation of error includes; using the spectral weights in computing a signal-to-noise ratio per frequency hand, the audio signal having been transformed to a signal spectrum with the signal spectrum divided into a number of frequency bands; and maximizing the signal-to-noise ratio in assignment of pulses to frequency coefficients in each frequency band.

In any of the preceding examples in accordance with the preceding first example processor-implemented method, a further implementation provides that, with the audio signal having been transformed to a signal spectrum with the signal spectrum divided into a number of frequency bands having a number of bins, generating spectral weights includes generating a spectral weight per frequency band and bin by: generating two smoothed spectrums, the two smoothed spectrums being of varying degrees of smoothing magnitude of the signal spectrum; determining a ratio of the two smoothed spectrums; and adjusting the ratio using an aggressivity factor, a bin tonality, and a band tonality.

In any of the preceding examples in accordance with the preceding first example processor-implemented method, a further implementation provides that generating frequency coefficients corresponding to the audio signal includes applying a window to a frame of time samples of the audio signal and computing a frequency transform on the frame of time samples to generate a spectrum representation of the frame.

In any of the preceding examples in accordance with the preceding first example processor-implemented method, a further implementation provides that generating the spectral weights includes computing a vector quantization weighting curve, performed in a simulation encoding, including: computing bin tonality and band tonality associated with the spectrum representation; generating a signal-to-mask ratio (SMR), the SMR associated with a masking curve across the spectrum representation; encoding the frame to generate simulated quantized frequency coefficients; decoding the frame to recover the simulated quantized frequency coefficients; computing a signal-over-noise ratio (SNR) between original frequency coefficients, determined prior to encoding the frame, and the recovered simulated quantized frequency coefficients; computing a noise-to-mask ratio (NMR) as a ratio of the SMR and the SNR; and computing the vector quantization weighting curve using the bin tonality, the band tonality, the SNR, and the NMR, wherein the encoding, decoding, and SNR computation are carried out in a given frequency domain, and the SMR and the NMR computations are carried out in the same frequency domain or in a different frequency domain.

In any of the preceding examples in accordance with the preceding first example processor-implemented method, a further implementation provides that, with the audio signal having been transformed to a signal spectrum with the signal spectrum divided into a number of frequency bands having a number of bins, using the generated spectral weights includes applying the generated spectral weights to all bins in a band in response to satisfying a condition, the condition including an average noise-to-mask ratio of the band being greater than a threshold for a band noise-to-mask ratio.

According to various embodiments, a first example machine-readable storage device comprises instructions, which when executed by a set of processors, cause a system to perform operations, the operations comprising operations to: generate frequency coefficients corresponding to an audio signal received at an input of an audio encoder; generate spectral weights to perceptually shape a vector quantizer error, the weights derived in a compromise between altering a spectrum of the audio signal and reducing artifacts caused by missing quantized coefficients corresponding to use of quantized coefficients without weights; quantize the frequency coefficients by use of the generated spectral weights applied to the frequency coefficients prior to the quantization or by use of the generated spectral weights in computation of error within a vector quantization that performs the quantization; pack the quantized frequency coefficients into a bitstream to provide an encoded bitstream; and output the encoded bitstream from the audio encoder, the encoded bitstream including components to produce a signal representative of the audio signal.

In accordance with the preceding first example machine-readable storage device, another implementation provides that the operations include operations to normalize the generated frequency coefficients in one or more frequency bands and to apply the spectral weights to the normalized generated frequency coefficients such that tonal peaks of high amplitude relative to tonal peaks of lower amplitude in a given frequency band are de-emphasized prior to the quantization.

In any of the preceding examples in accordance with the preceding first example machine-readable storage device, a further implementation provides that the operations to quantize the frequency coefficients by use of the generated spectral weights in the computation of error include operations to: use the spectral weights in computation of a signal-to-noise ratio per frequency band, the audio signal having been transformed to a signal spectrum with the signal spectrum divided into a number of frequency hands; and maximize the signal-to-noise ratio in assignment of pulses to frequency coefficients in each frequency band.

In any of the preceding examples in accordance with the preceding first example machine-readable storage device, a further implementation provides that, with a transformation of the audio signal to a signal spectrum with the signal spectrum divided into a number of frequency bands having a number of bins, operations to generate the spectral weights include operations to generate a spectral weight per frequency band and bin by: generation of two smoothed spectrums, the two smoothed spectrums being of varying degrees of smoothing magnitude of the signal spectrum; determination of a ratio of the two smoothed spectrums; and adjustment of the ratio by use of an aggressivity factor, a bin tonality, and a band tonality.

In any of the preceding examples in accordance with the preceding first example machine-readable storage device, a further implementation provides that operations to generate the spectral weights includes a computation of a vector quantization weighting curve, performed in a simulation encoding, the computation including operations to: compute bin tonality and band tonality associated with a spectrum representation of a frame of time samples of the audio signal, the spectrum representation generated by a computation of a frequency transform on the frame of time samples; generate a signal-to-mask ratio (SMR), the SMR associated with a masking curve across the spectrum representation; encode the frame to generate simulated quantized frequency coefficients; decode the encoded frame to recover the simulated quantized frequency coefficients; compute a signal-over-noise ratio (SNR) between original frequency coefficients, determined prior to encoding the frame, and the recovered simulated quantized frequency coefficients; compute a noise-to-mask ratio (NMR) as a ratio of the SMR and the SNR; and compute the vector quantization weighting curve using the bin tonality, the band tonality, the SNR, and the NMR, wherein the encoding, decoding, and SNR computation are carried out in a given frequency domain, and the SMR and the NMR computations are carried out in the same frequency domain or in a different frequency domain.

Many other variations than those described herein will be apparent from this document. For example, depending on the embodiment, certain acts, events, or functions of any of the methods and algorithms described herein can be performed in a different sequence, can be added, merged, or left out altogether (such that not all described acts or events are necessary for the practice of the methods and algorithms). Moreover, in certain embodiments, acts or events can be performed concurrently, such as through multi-threaded processing, interrupt processing, or multiple processors or processor cores or on other parallel architectures, rather than sequentially. In addition, different tasks or processes can be performed by different machines and computing systems that can function together.

The various illustrative logical blocks, modules, methods, and algorithm processes and sequences described in connection with the embodiments disclosed herein can be implemented as electronic hardware, computer software, or combinations of both. To clearly illustrate this interchangeability of hardware and software, various illustrative components, blocks, modules, and process actions have been described above generally in terms of their functionality. Whether such functionality is implemented as hardware or software depends upon the particular application and design constraints imposed on the overall system. The described functionality can be implemented in varying ways for each particular application, but such implementation decisions should not be interpreted as causing a departure from the scope of this document.

The various illustrative logical blocks and modules described in connection with the embodiments disclosed herein can be implemented or performed by a machine, such as a general purpose processor, a processing device, a computing device having one or more processing devices, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general purpose processor and processing device can be a microprocessor, but in the alternative, the processor can be a controller, microcontroller, or state machine, combinations of the same, or the like. A processor can also be implemented as a combination of computing devices, such as a combination of a DSP and a microprocessor, a plurality of microprocessors, one or more microprocessors in conjunction with a DSP core, or any other such configuration.

Embodiments of the harmonic coding signal system and method described herein are operational within numerous types of general purpose or special purpose computing system environments or configurations. In general, a computing environment can include any type of computer system, including, but not limited to, a computer system based on one or more microprocessors, a mainframe computer, a digital signal processor, a portable computing device, a personal organizer, a device controller, a computational engine within an appliance, a mobile phone, a desktop computer, a mobile computer, a tablet computer, a smartphone, and appliances with an embedded computer, to name a few.

Such computing devices can be typically found in devices having at least some minimum computational capability, including, but not limited to, personal computers, server computers, hand-held computing devices, laptop or mobile computers, communications devices such as cell phones and PDA's, multiprocessor systems, microprocessor-based systems, set top boxes, programmable consumer electronics, network PCs, minicomputers, mainframe computers, audio or video media players, and so forth. In some embodiments the computing devices will include one or more processors. Each processor may be a specialized microprocessor, such as a digital signal processor (DSP), a very long instruction word (VLIW), or other micro-controller, or can be conventional central processing units (CPUs) having one or more processing cores, including specialized graphics processing unit (GPU)-based cores in a multi-core CPU.

The process actions or operations of a method, process, or algorithm described in connection with the embodiments disclosed herein can be embodied directly in hardware, in a software module executed by a processor, or in any combination of the two. The software module can be contained in computer-readable media that can be accessed by a computing device. The computer-readable media includes both volatile and nonvolatile media that is either removable, non-removable, or some combination thereof The computer-readable media is used to store information such as computer-readable or computer-executable instructions, data structures, program modules, or other data. By way of example, and not limitation, computer readable media may comprise computer storage media and communication media.

Computer storage media includes, but is not limited to, computer or machine readable media or storage devices such as Blu-ray discs (BD), digital versatile discs (DVDs), compact discs (CDs), floppy disks, tape drives, hard drives, optical drives, solid state memory devices, RAM memory, ROM memory, EPROM memory, EEPROM memory, flash memory or other memory technology, magnetic cassettes, magnetic tapes, magnetic disk storage, or other magnetic storage devices, or any other device which can be used to store the desired information and which can be accessed by one or more computing devices.

A software module can reside in RAM memory, flash memory, ROM memory, EPROM memory, EEPROM memory, registers, hard disk, a removable disk, a CD-ROM, or any other form of non-transitory computer-readable storage medium, media, or physical computer storage known in the art. An exemplary storage medium can be coupled to the processor such that the processor can read information from, and write information to, the storage medium. In the alternative, the storage medium can be integral to the processor. The processor and the storage medium can reside in an application specific integrated circuit (ASIC). The ASIC can reside in a user terminal. Alternatively, the processor and the storage medium can reside as discrete components in a user terminal.

The phrase "non-transitory" as used in this document means "enduring or long-lived". The phrase "non-transitory computer-readable media" includes any and all computer-readable media, with the sole exception of a transitory, propagating signal. This includes, by way of example and not limitation, non-transitory computer-readable media such as register memory, processor cache and random-access memory (RAM).

Retention of information such as computer-readable or computer-executable instructions, data structures, program modules, and so forth, can also be accomplished by using a variety of the communication media to encode one or more modulated data signals, electromagnetic waves (such as carrier waves), or other transport mechanisms or communications protocols, and includes any wired or wireless information delivery mechanism. In general, these communication media are associated with a signal that has one or more of its characteristics set or changed in such a manner as to encode information or instructions in the signal. For example, communication media includes wired media such as a wired network or direct-wired connection carrying one or more modulated data signals, and wireless media such as acoustic, radio frequency (RF), infrared, laser, and other wireless media for transmitting, receiving, or both, one or more modulated data signals or electromagnetic waves. Combinations of the any of the above should also be included within the scope of communication media.

Further, one or any combination of software, programs, computer program products that embody some or all of the various embodiments of the harmonic coding signal system and method described herein, or portions thereof, may be stored, received, transmitted, or read from any desired combination of computer or machine readable media or storage devices and communication media in the form of computer executable instructions or other data structures.

Embodiments of the harmonic coding signal system and method described herein may be further described in the general context of computer-executable instructions, such as program modules, being executed by a computing device. Generally, program modules include routines, programs, objects, components, data structures, and so forth, which perform particular tasks or implement particular abstract data types. The embodiments described herein may also be practiced in distributed computing environments where tasks are performed by one or more remote processing devices, or within a cloud of one or more devices, that are linked through one or more communications networks. In a distributed computing environment, program modules may be located in both local and remote computer storage media including media storage devices. Still further, the aforementioned instructions may be implemented, in part or in whole, as hardware logic circuits, which may or may not include a processor.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

While the above detailed description has shown, described, and pointed out novel features as applied to various embodiments, it will be understood that various omissions, substitutions, and changes in the form and details of the devices or algorithms illustrated can be made without departing from the scope of the disclosure. As will be recognized, certain embodiments of the inventions described herein can be embodied within a form that does not provide all of the features and benefits set forth herein, as some features can be used or practiced separately from others.

Each patent and publication referenced or mentioned herein is hereby incorporated by reference to the same extent as if it had been incorporated by reference in its entirety individually or set forth herein in its entirety. Any conflicts of these patents or publications with the teachings herein are controlled by the teaching herein. Although specific embodiments have been illustrated and described herein, it will be appreciated by those of ordinary skill in the art that any arrangement that is calculated to achieve the same purpose may be substituted for the specific embodiments shown. Various embodiments use permutations and/or combinations of embodiments described herein. It is to be understood that the above description is intended to be illustrative, and not restrictive, and that the phraseology or terminology employed herein is for the purpose of description. Combinations of the above embodiments and other embodiments will be apparent to those of skill in the art upon studying the above description.

What is claimed is:

1. A system having an audio codec, the system comprising:

an input to the audio encoder to receive an audio signal;

one or more processors;

a memory storage having instructions stored therein, the instructions executable by the one or more processors to cause the audio encoder to perform operations to:

generate frequency coefficients corresponding to the audio signal;

generate spectral weights to perceptually shape a vector quantizer error, the weights derived in a compromise between altering a spectrum of the audio signal and reducing artifacts caused by missing quantized coefficients corresponding to use of quantized coefficients without weights;

quantize the frequency coefficients by use of the generated spectral weights applied to the frequency coefficients prior to the quantization or by use of the generated spectral weights in computation of error within a vector quantization that performs the quantization;

pack the quantized frequency coefficients into a bitstream to provide an encoded bitstream; and output the encoded bitstream from the audio encoder, the encoded bitstream including components to produce a signal representative of the audio signal; and an audio decoder that decodes the encoded bitstream without using spectral weights such that spectral weights are only generated and used by the audio encoder.

2. The system of claim 1, wherein the operations include a normalization of the generated frequency coefficients in one or more frequency bands and an application of the spectral weights to the normalized generated frequency coefficients such that tonal peaks of high amplitude relative to tonal peaks of lower amplitude in a given frequency band are deemphasized prior to the quantization.

3. The system of claim 1, wherein quantization of the frequency coefficients by use of the generated spectral weights in the computation of error includes:

a use of the spectral weights in computation of a signal-to-noise ratio per frequency band, the audio signal having been transformed to a signal spectrum with the signal spectrum divided into a number of frequency bands; and a maximization of the signal-to-noise ratio in assignment of pulses to frequency coefficients in each frequency band.

4. The system of claim 1, wherein, with the audio signal having been transformed to a signal spectrum with the signal spectrum divided into a number of frequency bands having a number of bins, generation of the spectral weights includes generation of a spectral weight per frequency band and bin by:

a generation of two smoothed spectrums, the two smoothed spectrums being of varying degrees of smoothing magnitude of the signal spectrum;

a determination of a ratio of the two smoothed spectrums; and an adjustment of the ratio by use of an aggressivity factor, a bin tonality, and a band tonality.

5. The system of claim 1, wherein generation of the frequency coefficients corresponding to the audio signal includes an application of a window to a frame of time samples of the audio signal and a computation of a frequency transform on the frame of time samples to generate a spectrum representation of the frame.

6. The system of claim 5, wherein generation of the spectral weights includes a computation of a vector quantization weighting curve, performed in a simulation encoding, including:

a computation of bin tonality and band tonality associated with the spectrum representation;

a generation of a signal-to-mask ratio (SMR), the SMR associated with a masking curve across the spectrum representation;

an encoding of the frame to generate simulated quantized frequency coefficients;

a decoding of the frame to recover the simulated quantized frequency coefficients;

a computation of a signal-over-noise ratio (SNR) between original frequency coefficients, determined prior to encoding the frame, and the recovered simulated quantized frequency coefficients;

a computation of a noise-to-mask ratio (NMR) as a ratio of the SMR and the SNR; and a computation of the vector quantization weighting curve using the bin tonality, the band tonality, the SNR, and the NMR, wherein the encoding, decoding, and SNR computation are carried out in a given frequency domain, and the SMR and the NMR computations are carried out in the same frequency domain or in a different frequency domain.

7. The system of claim 1, wherein, with the audio signal having been transformed to a signal spectrum with the signal spectrum divided into a number of frequency bands having a number of bins, use of the generated spectral weights includes an application of the generated spectral weights to all bins in a band in response to satisfaction of a condition, the condition including an average noise-to-mask ratio of the band being greater than a threshold for a band noise-to-mask ratio.

8. The system of claim 1, wherein information about how a weighting curve was computed for the spectral weights for the audio signal is included in the encoded bitstream.

9. A processor-implemented method comprising:

generating frequency coefficients corresponding to an audio signal received at an input of an audio encoder;

generating spectral weights to perceptually shape a vector quantizer error, the weights derived in a compromise between altering a spectrum of the audio signal and reducing artifacts caused by missing quantized coefficients corresponding to using quantized coefficients without weights;

quantizing the frequency coefficients using the generated spectral weights applied to the frequency coefficients prior to quantizing or using the generated spectral weights in computation of error within a vector quantization performing the quantizing;

packing the quantized frequency coefficients into a bitstream providing an encoded bitstream;

outputting the encoded bitstream from the audio encoder, the encoded bitstream including components to produce a signal representative of the audio signal; and decoding the encoded bitstream without using spectral weights such that spectral weights are only generated and used by the audio encoder.

10. The processor-implemented method of claim 9, wherein the processor-implemented method includes normalizing the generated frequency coefficients in one or more frequency bands and applying the spectral weights to the normalized generated frequency coefficients such that tonal peaks of high amplitude relative to tonal peaks of lower amplitude in a given frequency band are de-emphasized prior to the quantizing.

11. The processor-implemented method of claim 9, wherein quantizing the frequency coefficients using the generated spectral weights in the computation of error includes:

using the spectral weights in computing a signal-to-noise ratio per frequency band, the audio signal having been transformed to a signal spectrum with the signal spectrum divided into a number of frequency bands; and maximizing the signal-to-noise ratio in assignment of pulses to frequency coefficients in each frequency band.

12. The processor-implemented method of claim 9, wherein, with the audio signal having been transformed to a signal spectrum with the signal spectrum divided into a number of frequency bands having a number of bins, generating spectral weights includes generating a spectral weight per frequency band and bin by:

generating two smoothed spectrums, the two smoothed spectrums being of varying degrees of smoothing magnitude of the signal spectrum;

determining a ratio of the two smoothed spectrums; and adjusting the ratio using an aggressivity factor, a bin tonality, and a band tonality.

13. The processor-implemented method of claim 9, wherein generating frequency coefficients corresponding to the audio signal includes applying a window to a frame of time samples of the audio signal and computing a frequency transform on the frame of time samples to generate a spectrum representation of the frame.

14. The processor-implemented method of claim 13, wherein generating the spectral weights includes computing a vector quantization weighting curve, performed in a simulation encoding, including:

computing bin tonality and band tonality associated with the spectrum representation;

generating a signal-to-mask ratio (SMR), the SMR associated with a masking curve across the spectrum representation;

encoding the frame to generate simulated quantized frequency coefficients;

decoding the frame to recover the simulated quantized frequency coefficients;

computing a signal-over-noise ratio (SNR) between original frequency coefficients, determined prior to encoding the frame, and the recovered simulated quantized frequency coefficients;

computing a noise-to-mask ratio (NMR) as a ratio of the SMR and the SNR; and computing the vector quantization weighting curve using the bin tonality, the band tonality, the SNR, and the NMR, wherein the encoding, decoding, and SNR computation are carried out in a given frequency domain, and the SMR and the NMR computations are carried out in the same frequency domain or in a different frequency domain.

15. The processor-implemented method of claim 9, wherein, with the audio signal having been transformed to a signal spectrum with the signal spectrum divided into a number of frequency bands having a number of bins, using the generated spectral weights includes applying the generated spectral weights to all bins in a band in response to satisfying a condition, the condition including an average noise-to-mask ratio of the band being greater than a threshold for a band noise-to-mask ratio.

16. A machine-readable storage device comprising instructions, which when executed by a set of processors, cause a system to perform operations, the operations comprising operations to:

generate frequency coefficients corresponding to an audio signal received at an input of an audio encoder;

generate spectral weights to perceptually shape a vector quantizer error, the weights derived in a compromise between altering a spectrum of the audio signal and reducing artifacts caused by missing quantized coefficients corresponding to use of quantized coefficients without weights;

quantize the frequency coefficients by use of the generated spectral weights applied to the frequency coefficients prior to the quantization or by use of the generated spectral weights in computation of error within a vector quantization that performs the quantization;

pack the quantized frequency coefficients into a bitstream to provide an encoded bitstream;

output the encoded bitstream from the audio encoder, the encoded bitstream including components to produce a signal representative of the audio signal; and decoding the encoded bitstream without using spectral weights such that spectral weights are only generated and used by the audio encoder.

17. The machine-readable storage device of claim 16, wherein the operations include operations to normalize the generated frequency coefficients in one or more frequency bands and to apply the spectral weights to the normalized generated frequency coefficients such that tonal peaks of high amplitude relative to tonal peaks of lower amplitude in a given frequency band are de-emphasized prior to the quantization.

18. The machine-readable storage device of claim 16, wherein the operations to quantize the frequency coefficients by use of the generated spectral weights in the computation of error include operations to:

use the spectral weights in computation of a signal-to-noise ratio per frequency band, the audio signal having been transformed to a signal spectrum with the signal spectrum divided into a number of frequency bands; and maximize the signal-to-noise ratio in assignment of pulses to frequency coefficients in each frequency band.

19. The machine-readable storage device of claim 16, wherein, with a transformation of the audio signal to a signal spectrum with the signal spectrum divided into a number of frequency bands having a number of bins, operations to generate the spectral weights include operations to generate a spectral weight per frequency band and bin by:

generation of two smoothed spectrums, the two smoothed spectrums being of varying degrees of smoothing magnitude of the signal spectrum;

determination of a ratio of the two smoothed spectrums; and adjustment of the ratio by use of an aggressivity factor, a bin tonality, and a band tonality.

20. The machine-readable storage device of claim 16, wherein operations to generate the spectral weights includes a computation of a vector quantization weighting curve, performed in a simulation encoding, the computation including operations to:

compute bin tonality and band tonality associated with a spectrum representation of a frame of time samples of the audio signal, the spectrum representation generated by a computation of a frequency transform on the frame of time samples;

generate a signal-to-mask ratio (SMR), the SMR associated with a masking curve across the spectrum representation;

encode the frame to generate simulated quantized frequency coefficients;

decode the encoded frame to recover the simulated quantized frequency coefficients;

compute a signal-over-noise ratio (SNR) between original frequency coefficients, determined prior to encoding the frame, and the recovered simulated quantized frequency coefficients;

compute a noise-to-mask ratio (NMR) as a ratio of the SMR and the SNR; and compute the vector quantization weighting curve using the bin tonality, the band tonality, the SNR, and the NMR, wherein the encoding, decoding, and SNR computation are carried out in a given frequency domain, and the SMR and the NMR computations are carried out in the same frequency domain or in a different frequency domain.

* * * * *